US011749178B2

(12) United States Patent
An et al.

(10) Patent No.: US 11,749,178 B2
(45) Date of Patent: Sep. 5, 2023

(54) DISPLAY DEVICE FOR PROVIDING TEST DATA SIGNALS OF DIFFERENT VOLTAGE LEVELS TO DIFFERENT AREAS OF A DISPLAY PANEL IN A TEST MODE

(71) Applicant: Samsung Display Co., Ltd., Yongin-Si (KR)

(72) Inventors: Jinsung An, Gwacheon-si (KR); Sungho Kim, Suwon-si (KR); Seokje Seong, Seongnam-si (KR); Minwoo Woo, Seoul (KR); Wangwoo Lee, Osan-si (KR); Jiseon Lee, Hwaseong-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/548,870

(22) Filed: Dec. 13, 2021

(65) Prior Publication Data

US 2022/0343836 A1 Oct. 27, 2022

(30) Foreign Application Priority Data

Apr. 26, 2021 (KR) ..... 10-2021-0053950

(51) Int. Cl.
*G09G 3/32* (2016.01)
*G09G 3/00* (2006.01)

(52) U.S. Cl.
CPC ..... *G09G 3/32* (2013.01); *G09G 3/006* (2013.01); *G09G 2300/0439* (2013.01);
(Continued)

(58) Field of Classification Search
CPC ..... G09G 3/006; G09G 3/32–3291; G09G 2300/0439; G09G 2300/0443;
(Continued)

(56) References Cited

U.S. PATENT DOCUMENTS 8,711,138 B2 4/2014 Kawabe
9,262,952 B2 2/2016 Kim et al.
(Continued)

FOREIGN PATENT DOCUMENTS

KR 10-1943069 4/2019
KR 10-2054849 12/2019
(Continued)

*Primary Examiner* — Nathan Danielsen
(74) *Attorney, Agent, or Firm* — F. Chau & Associates, LLC

(57) ABSTRACT

A display device that includes: a display panel including a plurality of pixels respectively connected to a corresponding data line of a plurality of data lines and a corresponding scan line of a plurality of scan lines; and a test circuit connected to the data lines, and wherein the display panel includes a first area having a first light transmittance and a second area having a second light transmittance, wherein the pixels include a first pixel in the first area and a second pixel in the second area, wherein the test circuit provides a first test data signal to a data line connected to the first pixel, and provides a second test data signal to a data line connected to the second pixel, and wherein a voltage level of the first test data signal is different from a voltage level of the second test data signal.

20 Claims, 20 Drawing Sheets

(52) U.S. Cl.
CPC ..... *G09G 2310/08* (2013.01); *G09G 2330/12* (2013.01); *G09G 2340/0435* (2013.01)

(58) Field of Classification Search
CPC ..... G09G 2300/045; G09G 2300/0465; G09G 2310/0243; G09G 2310/0251; G09G 2310/027–0275; G09G 2310/0297; G09G 2310/06; G09G 2310/08; G09G 2320/0233; G09G 2320/0242; G09G 2330/12; G09G 2340/0435
See application file for complete search history.

(56) References Cited

U.S. PATENT DOCUMENTS

| | | | | |
|---|---|---|---|---|
| 9,390,644 | B2 | 7/2016 | Ka et al. | |
| 9,990,873 | B2 | 6/2018 | Jang et al. | |
| 2019/0311662 | A1* | 10/2019 | Kim | G09G 3/006 |
| 2020/0161399 | A1* | 5/2020 | Park | G09G 3/3225 |
| 2020/0327834 | A1 | 10/2020 | Kim et al. | |
| 2021/0065635 | A1* | 3/2021 | Choi | G09G 3/3225 |
| 2021/0097936 | A1* | 4/2021 | Ge | G09G 3/2011 |
| 2021/0104196 | A1* | 4/2021 | Yuan | G09G 3/3258 |
| 2021/0174743 | A1* | 6/2021 | Chang | G09G 3/3258 |
| 2021/0407419 | A1* | 12/2021 | Li | G09G 3/3258 |

FOREIGN PATENT DOCUMENTS

| | | |
|---|---|---|
| KR | 10-2020-0120781 | 10/2020 |
| KR | 10-2174368 | 11/2020 |

* cited by examiner

DISPLAY DEVICE FOR PROVIDING TEST DATA SIGNALS OF DIFFERENT VOLTAGE LEVELS TO DIFFERENT AREAS OF A DISPLAY PANEL IN A TEST MODE

CROSS-REFERENCE TO RELATED APPLICATION

This application claims priority under 35 U.S.C. § 119 to Korean Patent Application No. 10-2021-0053950 filed on Apr. 26, 2021, in the Korean Intellectual Property Office, the disclosure of which is incorporated by reference herein in its entirety.

TECHNICAL FIELD

Embodiments of the present disclosure relate to a display device, and more particularly, to a display device including a test circuit capable of testing a display panel.

DISCUSSION OF RELATED ART

A display device is an output device for presentation of information in visual form. Various types of display devices may include an electronic module that receives an external signal or provides an output signal to the outside. For example, the electronic module may include an infrared detection sensor, a proximity sensor, a camera module, etc.

In an effort to increase an image display area in the display device, a camera module is disposed in the image display area. The number of pixels disposed in an area overlapping the electronic module may be decreased to prevent performance degradation of the electronic module.

SUMMARY

Embodiments of the present disclosure provide a display device capable of testing a display area in which an electronic module is disposed.

According to an embodiment of the present disclosure, a display device includes: a display panel including a plurality of pixels respectively connected to a corresponding data line of a plurality of data lines and a corresponding scan line of a plurality of scan lines; and a test circuit electrically connected to the data lines, and wherein the display panel includes a first area having a first light transmittance and a second area having a second light transmittance, wherein the plurality of pixels includes a first pixel disposed in the first area and a second pixel disposed in the second area, wherein the test circuit provides a first test data signal to a data line connected to the first pixel among the plurality of data lines when the first pixel is driven, and provides a second test data signal to a data line connected to the second pixel among the plurality of data lines when the second pixel is driven, and wherein a voltage level of the first test data signal is different from a voltage level of the second test data signal.

The first light transmittance of the first area may be greater than the second light transmittance of the second area.

A first voltage level of the first test data signal may be greater than a second voltage level of the second test data signal.

The display panel may operate in a normal mode at a first driving frequency and a low frequency mode at a second driving frequency lower than the first driving frequency, wherein each of the plurality of pixels may include a plurality of transistors, and wherein the low frequency mode may include a driving frame in which all of the plurality of transistors are driven and a bias frame in which less than all of the plurality of transistors are driven.

The test circuit may provide the first test data signal to the data line connected to the first pixel when the first pixel is driven during the bias frame, and provide the second test data signal to the data line connected to the second pixel when the second pixel is driven during the bias frame.

The test circuit may be in an inactive state during the driving frame.

Each of the first pixel and the second pixel may include: a first transistor including a first electrode electrically connected to a first voltage line, a second electrode, and a gate electrode; a second transistor including a first electrode connected to the corresponding data line of the plurality of data lines, a second electrode electrically connected to the first electrode of the first transistor, and a gate electrode for receiving a first scan signal; a third transistor including a first electrode electrically connected to the second electrode of the first transistor, a second electrode electrically connected to the gate electrode of the first transistor, and a gate electrode for receiving a second scan signal; and a light emitting diode including a first electrode electrically connected to the second electrode of the first transistor and a second electrode connected to a second voltage line for receiving a second voltage, and wherein the first scan signal and the second scan signal may be activated during the driving frame, and wherein the first scan signal may be activated and the second scan signal may maintain an inactive state during the bias frame.

Each of the first transistor and the second transistor may be a P-type transistor, and the third transistor may be an N-type transistor.

The test circuit may include: a first switching circuit configured to provide the second test data signal to the plurality of data lines in response to a first gate signal and a second gate signal; and a second switching circuit configured to provide the first test data signal to the plurality of data lines in response to a third gate signal.

The first switching circuit may include: a first switching transistor and a second switching transistor connected in series between a data line electrically connected to both the first pixel and the second pixel and a second test data line transferring the second test data signal, wherein a gate electrode of the first switching transistor may receive the first gate signal, and wherein a gate electrode of the second switching transistor may receive the second gate signal.

The second switching circuit may include: a third switching transistor connected in series between a data line electrically connected to both the first pixel and the second pixel and a first test data line transferring the first test data signal, and wherein a gate electrode of the third switching transistor may receive the third gate signal.

The display device may further include: an electronic module overlapping the first area.

The electronic module may be a camera.

The number of first pixels per unit area of the first area may be less than the number of second pixels per unit area of the second area.

According to an embodiment of the present disclosure, a display device includes: a display panel including a plurality of pixels respectively connected to a corresponding data line of a plurality of data lines and a corresponding scan line of a plurality of scan lines; and a test circuit disposed on the display panel and electrically connected to the data lines, and wherein the display panel includes a first area having a first light transmittance and a second area having a second light transmittance, wherein die plurality of pixels includes a first pixel disposed in the first area and a second pixel disposed in the second area, and wherein each of the first pixel and the second pixel includes: a first transistor including a first electrode electrically connected to a first voltage line, a second electrode, and a gate electrode; a second transistor including a first electrode connected to the corresponding data line of the plurality of data lines, a second electrode electrically connected to the first electrode of the first transistor, and a gate electrode for receiving a first scan signal; a third transistor including a first electrode electrically connected to the second electrode of the first transistor, a second electrode electrically connected to the gate electrode of the first transistor, and a gate electrode for receiving a second scan signal; and a light emitting diode including a first electrode electrically connected to the second electrode of the first transistor and a second electrode connected to a second voltage line for receiving a second voltage, and wherein the first scan signal and the second scan signal are activated during a driving frame, and the first scan signal is activated and the second scan signal maintains an inactive state during a bias frame, wherein the test circuit provides a first test data signal to the first pixel when the first scan signal provided to the first pixel during the bias frame is activated, and provides a second test data signal to the second pixel when the first scan signal provided to the second pixel during the bias frame is activated, and wherein a voltage level of the first test data signal is different from a voltage level of the second test data signal.

The first light transmittance of the first area may be greater than the second light transmittance of the second area, and a first voltage level of the first test data signal may be greater than a second voltage level of the second test data signal.

The display panel may operate in a normal mode at a first driving frequency and a low frequency mode at a second driving frequency lower than the first driving frequency, and the low frequency mode may include the driving frame and the bias frame.

The test circuit may be in an inactive state during the driving frame.

The test circuit may include: a first switching circuit configured to provide the second test data signal to the plurality of data lines in response to a first gate signal and a second gate signal; and a second switching circuit configured to provide the first test data signal to the plurality of data lines in response to a third gate signal.

The display device may further include: an electronic module overlapping the first area.

BRIEF DESCRIPTION OF THE FIGURES

The above and other features of the present disclosure will become apparent by describing in detail embodiments thereof with reference to the accompanying drawings.

DETAILED DESCRIPTION OF THE EMBODIMENTS

Figure 1:
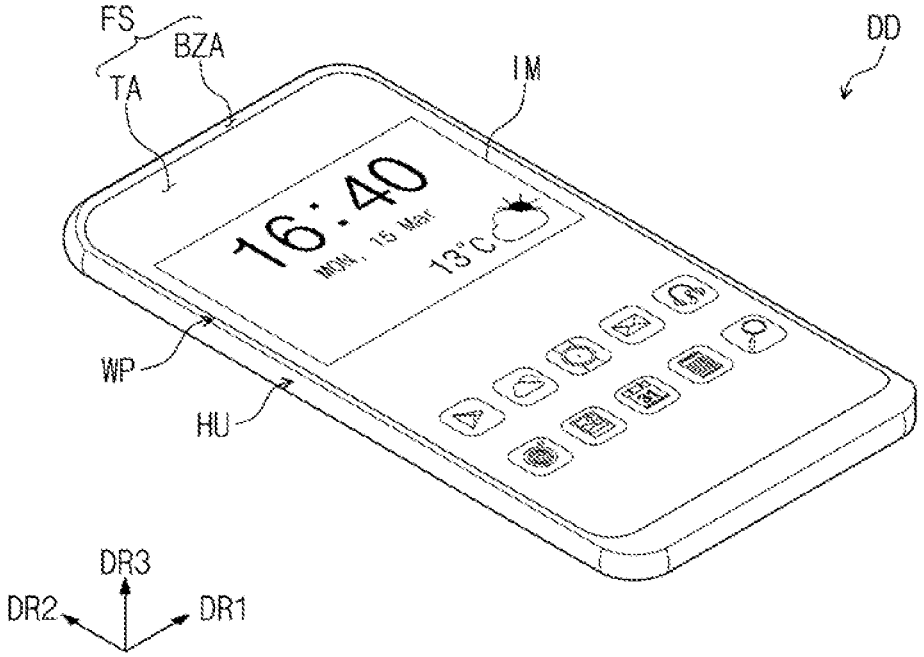
FIG. 1 is a combined perspective view of a display device according to an embodiment of the present disclosure.

In the present specification, when one component (or area, layer, part, or the like) is referred to as being "on", "connected to", or "coupled to" another component, it should be understood that the former may be directly on, connected to, or coupled to the latter, and also may be on, connected to, or coupled to the latter via a third intervening component.

Like reference numerals may refer to like components throughout the specification. In addition, in drawings, the thickness, ratio, and dimension of components may be exaggerated for an effective description of the technical content. The term "and/or" includes one or more combinations of the associated listed items.

The terms "first", "second", etc. may be used to describe various components, but the components are not limited by the terms. The terms are used to differentiate one component from another component. For example, a first component may be named as a second component, and vice versa. A singular form, unless otherwise stated, may include a plural form.

In addition, the terms "under", "beneath", "on", "above" are used to describe a relationship between components illustrated in a drawing. The terms are relative and are described with reference to a direction indicated in the drawing.

It will be understood that the terms "include", "comprise", "have", etc. specify the presence of features, numbers, steps, operations, elements, or components, described in the specification, or a combination thereof, but do not preclude the presence or additional possibility of one or more other features, numbers, steps, operations, elements, or components or a combination thereof.

Unless defined otherwise, all terms (including technical and scientific terms) used herein have the same meaning as commonly understood by one of ordinary skill in the art to which this disclosure belongs. In addition, terms such as terms defined in commonly used dictionaries should be interpreted as having a meaning consistent with the meaning in the context of the related technology, and should not be interpreted as an ideal or excessively formal meaning unless explicitly defined in the present disclosure.

Hereinafter, embodiments of the present disclosure will be described with reference to accompanying drawings.

Figure 2:
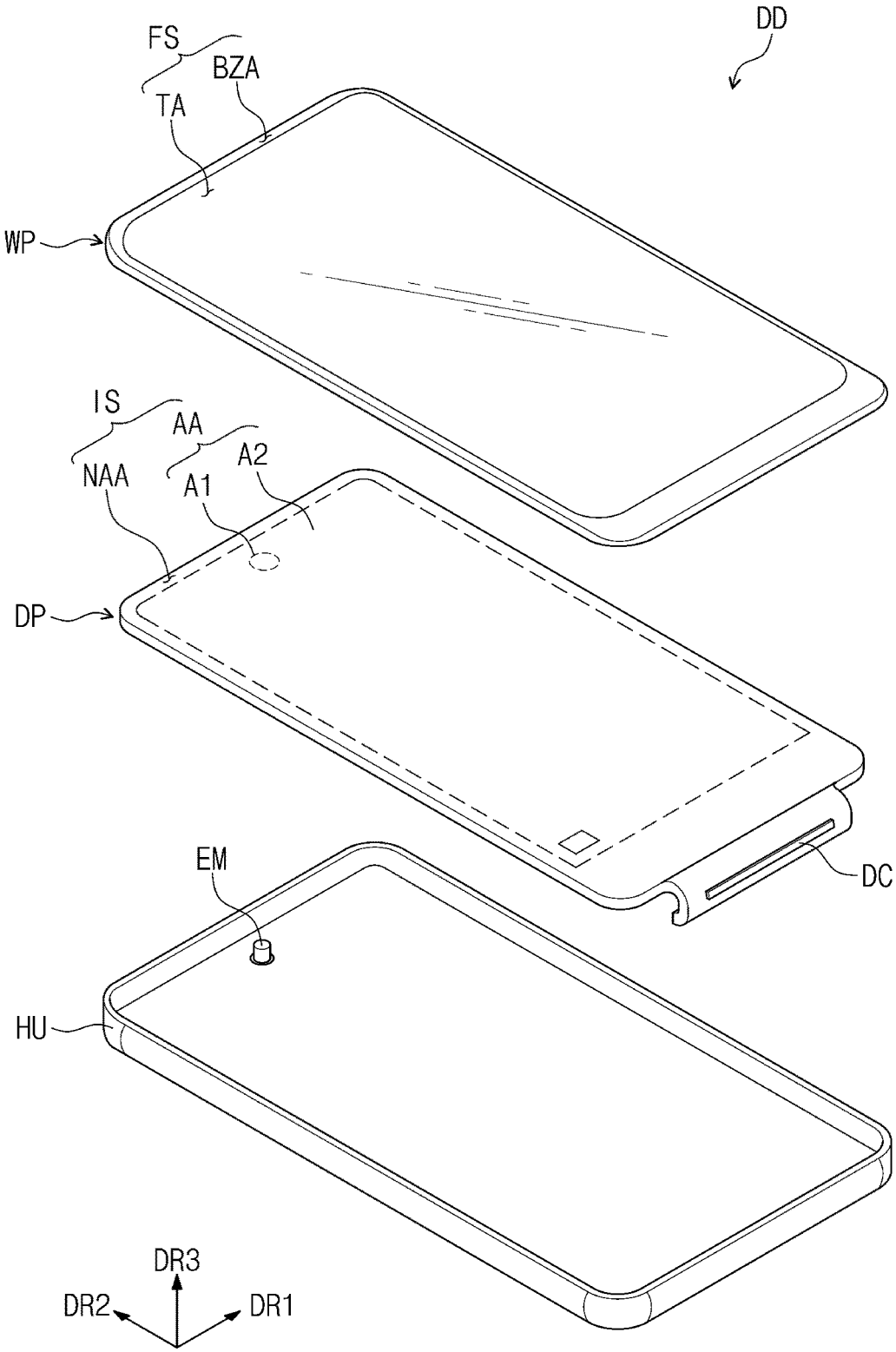
FIG. 2 is an exploded perspective view of a display device according to an embodiment of the present disclosure.

FIG. 1 is a combined perspective view of a display device according to an embodiment of the present disclosure. FIG. 2 is an exploded perspective view of a display device according to an embodiment of the present disclosure.

Referring to FIGS. 1 and 2, a display device DD may be a device that is activated by an electrical signal. The display device DD may be used in various implementations. For example, the display device DD may be used in large electronic devices such as televisions, monitors, or external billboards, as well as small and medium-sized devices such as personal computers, notebook computers, personal digital terminals, car navigation units, game consoles, portable electronic devices, and cameras. In addition, the display device DD may be applied to various other electronic devices. In this embodiment, the display device DD is illustrated as a smart phone.

The display device DD may display an image IM toward a third direction DR3 on a display surface FS parallel to each of first and second directions DR1 and DR2. The image IM may include a still image as well as a moving image. In FIG. 1, a clock and icons are illustrated as an example of the image IM. The display surface FS on which the image IM is displayed may correspond to a front surface of the display device DD and may correspond to a front surface of a window panel WP.

In this embodiment, a front surface (or upper surface) and a rear surface (or lower surface) of each member are defined based on a direction in which the image IM is displayed. The front and rear surfaces may be opposed to each other in the third direction DR3, and a normal direction of each of the front and rear surfaces may be parallel to the third direction DR3. In addition, the directions indicated by the first to third directions DR1, DR2, and DR3 are relative concepts and may be converted to other directions.

The display device DD according to an embodiment of the present disclosure may detect an externally applied user's input. The user's input includes various types of external inputs such as a part of the user's body, light, heat, or pressure. In addition, the display device DD may detect a user's input applied to a side surface or the rear surface of the display device DD depending on a structure of the display device DD, and is not limited to any one embodiment.

The display device DD may include the window panel WP, a display panel DP, an electronic module EM, and a housing HU. In the present embodiment, the window panel WP and the housing HU are combined to form an exterior of the display device DD.

The window panel WP may include an optically transparent insulating material. For example, the window panel WP may include glass or plastic. The window panel WP may have a multilayer structure or a single layer structure. For example, the window panel WP may include a plurality of plastic films bonded with an adhesive, or may include a glass substrate and a plastic film bonded with an adhesive.

As described above, the display surface FS of the window panel WP forms the front surface of the display device DD. The display surface FS may include a transmissive area TA and a bezel area BZA.

The transmissive area TA may be an optically transparent area. For example, the transmissive area TA may be an area having a visible light transmittance of about 90% or more. The bezel area BZA may have a relatively low light transmittance compared to the transmissive area TA. The bezel area BZA may have a predetermined color. The bezel area BZA defines the shape of the transmissive area TA. The bezel area BZA is adjacent to the transmissive area TA and may surround the transmissive area TA. In the window panel WP according to an embodiment of the present disclosure, the bezel area BZA may be omitted.

The display panel DP may display the image IM and detect an external input. A display panel DP includes a front surface IS including an active area AA and a peripheral area NAA. The active area AA may be an area activated by an electrical signal.

In this embodiment, the active area AA may be an area in which the image IM is displayed, and may also be an area in which an external input is detected. The transmissive area TA overlaps at least the active area AA. For example, the transmissive area TA overlaps the entire surface or at least a part of the active area AA. As another example, the transmissive area TA may overlap the entire surface of the active area AA except for a portion where the electronic module EM is disposed. Accordingly, the user may visually recognize the image IM through the transmissive area TA or provide an external input. However, this is illustrated by way of example, and an area in which the image IM is displayed and an area in which the external input is detected in the active area AA may be separated from each other, and it is not limited to any one embodiment.

The peripheral area NAA may be an area covered by the bezel area BZA. The peripheral area NAA is adjacent to the active area AA. The peripheral area NAA may surround the active area AA. In another example, the peripheral area NAA may be provided on less than all sides of the active area AA. A driving circuit or driving wiring for driving the active area AA may be disposed in the peripheral area NAA.

In this embodiment, the display panel DP is assembled in a flat state in which the active area AA and the peripheral area NAA face the window panel WP. However, this is illustrated by way of example, and a part of the peripheral area NAA of the display panel DP may be bent. In this case, a part of the peripheral area NAA may face the rear surface of the display device DD, such that the size of the bezel area BZA in the front surface of the display device DD may be reduced. Alternatively, a part of the active area AA of the display panel DP may also be assembled in a bent state.

The display panel DP may include a driving circuit DC disposed in the peripheral area NAA. The driving circuit DC may be mounted on a bent portion of the display panel DP. The driving circuit DC is implemented as an integrated circuit and may be mounted in the peripheral area NAA.

The display panel DP may generate the image IM. The image IM generated by the display panel DP may be visually recognized by a user at the outside through the transmissive area TA of the window panel WP.

Figure 3:
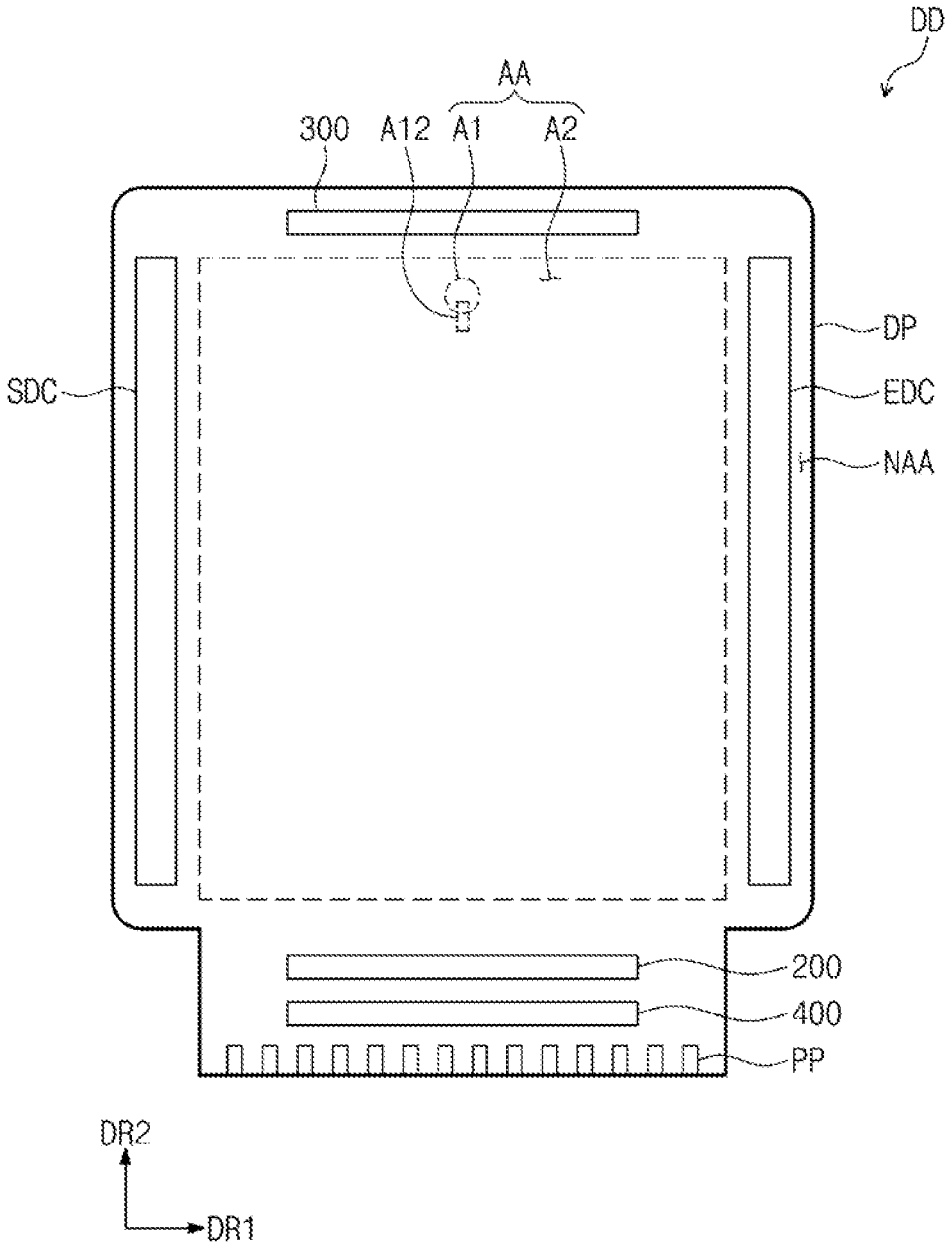
FIG. 3 is a plan view of a display panel according to an embodiment of the present disclosure.

The display panel DP may include a plurality of signal pads PD (refer to FIG. 3). The display panel DP may be electrically connected to a main controller, a voltage generator for supplying a power source, or test equipment through the signal pads.

The electronic module EM may be disposed under the display panel DP. In an embodiment of the present disclosure, the electronic module EM may be coupled to the rear surface of the display panel DP through an adhesive member.

On a plane, the electronic module EM may overlap the active area AA. Accordingly, a space to accommodate the electronic module EM in the bezel area BZA is not needed, and thus, an increase in an area of the bezel area BZA may be prevented.

A first area A1 and a second area A2 may be included in the display panel DP. The first area A1 and the second area A2 may constitute the active area AA of the display panel DP. The second area A2 may surround the first area A1.

The first area A1 may overlap the electronic module EM on a plane and may be an area adjacent to the second area A2. A resolution of the first area A1 may be different from a resolution of the second area A2. For example, the resolution of the first area A1 may be lower than that of the second area A2.

The transmittance of the first area A1 may be greater than that of the second area A2.

For example, when the electronic module EM includes a light source device that outputs light such as an infrared light emitting diode, an organic emission diode, a laser diode, or a phosphor, the electronic module EM may output light to the outside through the first area A1 of the active area AA and the transmissive area TA. When the electronic module EM is a light-receiving module such as an infrared detection sensor, a proximity sensor, a charge-coupled device (CCD), a light detection sensor, a phototransistor, or a photodiode, the electronic module EM may receive external light through the transmissive area TA and the first area A1 of the active area AA. In an embodiment of the present disclosure, the electronic module EM may be a camera. The electronic module EM may not to be configured as a single device, and may be configured in a form of an array in which a plurality of components are gathered.

The housing HU is combined with the window panel WP. The housing HIU may be combined with the window panel WP to provide a space for accommodating the display panel DP and the electronic module EM.

The housing HU may include a material having relatively high rigidity. For example, the housing HU may include glass, plastic, or metal, or may include a plurality of frames and/or plates composed of a combination thereof. The housing HU may stably protect components of the display device DD accommodated in an internal space from external impact.

FIG. 3 is a plan view of the display panel DP according to an embodiment of the present disclosure.

As illustrated in FIG. 3, the display panel DP includes a scan driving circuit SDC, an emission driving circuit EDC, the driving circuit DC, a first test circuit 300, a second test circuit 400, and the plurality of signal pads PD. A plurality of pixels PX (refer to FIG. 4) may be disposed in the active area AA of the display panel DP.

The scan driving circuit SDC generates a plurality of scan signals (hereinafter, scan signals), and sequentially outputs the scan signals to a plurality of scan lines to be described later. The scan driving circuit SDC may output not only the scan signals but also other control signals to the pixels PX.

The scan driving circuit SDC may include a plurality of transistors formed through the same process as transistors in the pixels PX.

The emission driving circuit EDC generates a plurality of light-emitting signals (hereinafter, light-emitting signals), and sequentially outputs the light-emitting signals to a plurality of light emitting lines to be described later. The emission driving circuit EDC may include a plurality of transistors formed through the same process as the transistors in the pixels PX.

The driving circuit DC generates a plurality of data signals (hereinafter, data signals) and outputs the data signals to a plurality of data lines to be described later. In addition, the driving circuit DC may control the scan driving circuit SDC and the emission driving circuit EDC.

The first test circuit 300 and the second test circuit 400 are disposed in the peripheral area NAA. In an embodiment of the present disclosure, the first test circuit 300 and the second test circuit 400 may be disposed facing each other with the active area AA interposed therebetween. For example, the first test circuit 300 and the second test circuit 400 may be disposed on opposite sides of the active area AA. In an embodiment of the present disclosure, the second test circuit 400 may be disposed adjacent to a data driving circuit 200. For example, the second test circuit 400 may be located between the data driving circuit 200 and the signal pads PD. In another embodiment of the present disclosure, the first test circuit 300 may be disposed adjacent to the data driving circuit 200.

The first test circuit 300 and the second test circuit 400 may be electrically connected to data lines of the active area AA. The first test circuit 300 and the second test circuit 400 will be described in detail later.

The scan driving circuit SDC, the emission driving circuit EDC, the data driving circuit 200, the first test circuit 300 and the second test circuit 400 may be electrically connected to the plurality of signal pads PD disposed on the peripheral area NAA through signal lines.

The display panel DP may receive voltages required for operation through some of the plurality of signal pads PD.

Figure 4:
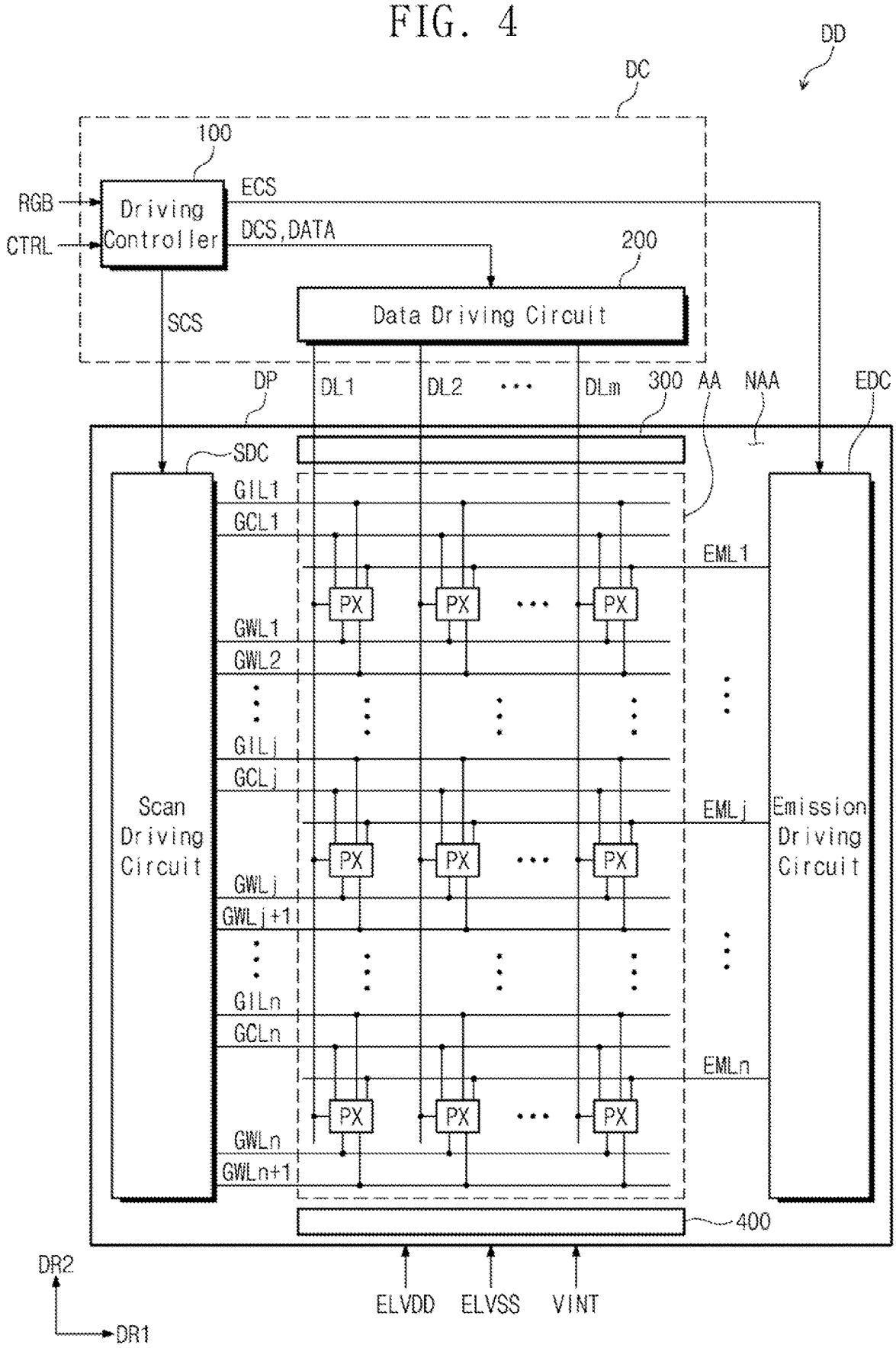
FIG. 4 is a block diagram of a display device according to an embodiment of the present disclosure.

FIG. 4 is a block diagram of a display device according to an embodiment of the present disclosure.

Referring to FIG. 4, the driving circuit DC may include a driving controller 100 and the data driving circuit 200. In an embodiment of the present disclosure, the driving circuit DC includes only the data driving circuit 200, and the driving circuit DC may be provided on a separate printed circuit board. In this case, the driving circuit DC may be electrically connected to the display panel DP and the data driving circuit 200 through the signal pads PD (refer to FIG. 3).

The driving controller 100 receives an image signal RGB and a control signal CTRL. The driving controller 100 generates an image data signal DATA obtained by converting a data format of the image signal RGB to meet the specification of an interface with the data driving circuit 200. The driving controller 100 outputs a scan control signal SCS, a data control signal DCS, and an emission control signal ECS.

The data driving circuit 200 receives the data control signal DCS and the image data signal DATA from the driving controller 100. The data driving circuit 200 converts the image data signal DATA into data signals, and outputs the data signals to a plurality of data lines DL1 to DLm, which will be described later. The data signals are analog voltages corresponding to gray scale values of the image data signal DATA.

The display panel DP includes scan lines GIL1 to GILn, GCL1 to GCLn, and GWL1 to GWLn+1, emission control lines EML1 to EMLn, the data lines DL1 to DLm, and pixels PX. The display panel DP may further include the scan driving circuit SDC and the emission driving circuit EDC. In an embodiment of the present disclosure, the scan driving circuit SDC is arranged on a first side of the display panel DP. The scan lines GIL1 to GILn, GCL1 to GCLn, and GWL1 to GWLn+1 extend in the first direction DR1 from the scan driving circuit SDC.

The emission driving circuit EDC is arranged on a second side of the display panel DP. The second side of the display panel is opposite the first side of the display panel DP. The emission control lines EML1 to EMLn extend in a direction opposite to the first direction DR1 from the emission driving circuit EDC.

The scan lines GIL1 to GILn, GCL1 to GCLn, and GWL1 to GWLn+1 and the emission control lines EML1 to EMLn are arranged to be spaced apart from each other in the second direction DR2. The data lines DL1 to DLm extend in a direction opposite to the second direction DR2 from the data driving circuit 200 and are arranged to be spaced apart from each other in the first direction DR1.

In the example illustrated in FIG. 4, the scan driving circuit SDC and the emission driving circuit EDC are arranged facing each other with pixels PX interposed therebetween, but the present disclosure is not limited thereto. For example, the scan driving circuit SDC and the emission driving circuit EDC may be disposed adjacent to each other on one of the first side and the second side of the display panel DP. In an embodiment of the present disclosure, the scan driving circuit SDC and the emission driving circuit EDC may be configured as one circuit.

The plurality of pixels PX are electrically connected to the scan lines GIL1 to GILn, GCL1 to GCLn, and GWL1 to GWLn+1, the emission control lines EML1 to EMLn, and the data lines DL1 to DLm, respectively. Each of the plurality of pixels PX may be electrically connected to four scan lines and one emission control line. For example, as illustrated in FIG. 4, the pixels PX in a first row may be connected to the scan lines GIL1, GCL1, GWL1, and GWL2 and the emission control line EML1. In addition, the pixels PX in the j-th row may be connected to the scan lines GILj, GCLj, GWLj, and GWLj+1 and an emission control line EMLj.

Each of the plurality of pixels PX includes a light emitting diode ED (refer to FIG. 5) and a pixel circuit PXC (refer to FIG. 5) that controls light emission of the light emitting diode ED. The pixel circuit PXC may include one or more transistors and one or more capacitors. The scan driving circuit SDC and the emission driving circuit EDC may include transistors formed through the same process as the pixel circuit PXC.

Each of the plurality of pixels PX receives a first driving voltage ELVDD, a second driving voltage ELVSS, and an initialization voltage VINT. The first driving voltage ELVDD, the second driving voltage ELVSS, and the initialization voltage VINT may be provided to the plurality of pixels PX through the signal pads PD illustrated in FIG. 3.

The scan driving circuit SDC receives the scan control signal SCS from the driving controller 100. The scan driving circuit SDC may output scan signals to the scan lines GIL1 to GILn, GCL1 to GCLn, and GWL1 to GWLn+1 in response to the scan control signal SCS. The circuit configuration and operation of the scan driving circuit SDC will be described in detail later.

The driving controller 100 according to an embodiment of the present disclosure may operate in a normal mode and a low frequency mode. In other words, the driving controller 100 may operate in a first mode and a second mode. The second driving frequency in the low frequency mode may be less than the first driving frequency in the normal mode. For example, when the first driving frequency in the normal mode is 120 Hz, the second driving frequency in the low frequency mode may be any one of 60 Hz, 30 Hz, 10 Hz, and 1 Hz.

Figure 5:
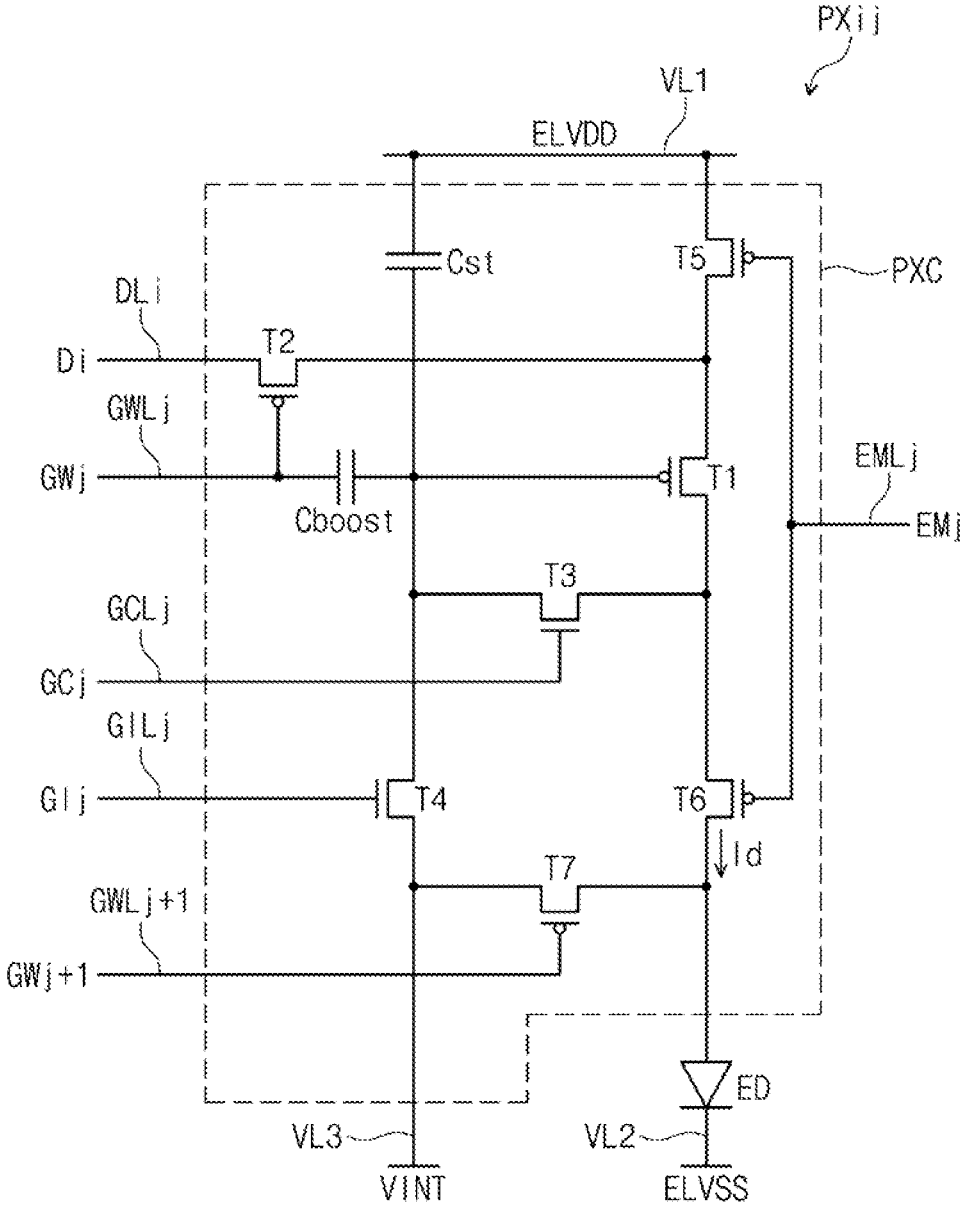
FIG. 5 is an equivalent circuit diagram of a pixel according to an embodiment of the present disclosure.

FIG. 5 is an equivalent circuit diagram of a pixel according to an embodiment of the present disclosure.

FIG. 5 illustrates an equivalent circuit diagram of a pixel PXij connected to an i-th data line DLi among the data lines DL1 to DLm, j-th scan lines GILj, GCLj, and GWLj and a j+1th scan line GWLj+1 among the scan lines GIL1 to GILn, GCL1 to GCLn, and GWL1 to GWLn+1, and a j-th emission control line EMLj among the emission control lines EML1 to EMLn, as illustrated in FIG. 4.

Each of the plurality of pixels PX illustrated in FIG. 4 may have the same circuit configuration as the equivalent circuit diagram of the pixel PXij illustrated in FIG. 5. In this embodiment, in the pixel circuit PXC of the pixel PXij, third and fourth transistors T3 and T4 among first to seventh transistors T1 to T7 are N-type transistors using an oxide semiconductor as a semiconductor layer, and each of the first, second, fifth, sixth, and seventh transistors T1, T2, T5, T6, and T7 is a P-type transistor having a low-temperature polycrystalline silicon (LTPS) semiconductor layer. However, the present disclosure is not limited thereto, and all of the first to seventh transistors T1 to T7 may be P-type transistors or N-type transistors. In another embodiment of the present disclosure, at least one of the first to seventh transistors T1 to T7 may be an N-type transistor, and the others may be P-type transistors. In addition, the circuit configuration of the pixel according to the present disclosure is not limited to FIG. 5. The pixel circuit PXC illustrated in FIG. 5 is only an example, and the configuration of the pixel circuit PXC may be modified and implemented.

Referring to FIG. 5, the pixel PXij of the display device according to an embodiment of the present disclosure includes the first to seventh transistors T1, T2, T3, T4, T5, T6, and T7, a first capacitor Cst, a second capacitor Cboost, and at least one light emitting diode ED. In this embodiment, an example in which one pixel PXij includes one light emitting diode ED will be described.

The scan lines GILj, GCLj, GWLj, and GWLj+1 may transfer the scan signals GIj, GCj, GWj, and GWj+1, respectively, and the emission control line EMLj may transfer an emission signal EMj. The data line DLi transfers a data signal Di. The data signal Di may have a voltage level corresponding to the image signal RGB input to the display device DD (refer to FIG. 4). First to third driving voltage lines VL1, VL2, and VL3 may transfer the first driving voltage ELVDD, the second driving voltage ELVSS, and the initialization voltage VINT, respectively.

The first transistor T1 includes a first electrode (corresponding to a source S1 in FIG. 9) connected to the first driving voltage line VL1 through the fifth transistor T5, a second electrode (corresponding to a drain D1 of FIG. 9) electrically connected to an anode of the light emitting diode ED through the sixth transistor T6, and a gate electrode connected to one end of the capacitor Cst. For example, the gate electrode of the first transistor T1 may be connected to a first terminal of the capacitor Cst. The first transistor T1 may receive the data signal Di transferred from the data line DLi depending on a switching operation of the second transistor T2 and may supply a driving current Id to the light emitting diode ED. The driving current Id may pass through the sixth transistor T6 before reaching the anode of the light emitting diode ED.

The second transistor T2 includes a first electrode connected to the data line DLi, a second electrode connected to the first electrode of the first transistor T1, and a gate electrode connected to the scan line GWLj. The second transistor T2 is turned on in response to the scan signal GWj transferred through the scan line GWLj, and may transfer the data signal Di transferred from the data line DLi to the first electrode of the first transistor T1.

The third transistor T3 includes a first electrode (corresponding to a drain D3 of FIG. 9) connected to the gate electrode of the first transistor T1, a second electrode connected to the second electrode (corresponding to a source S3 of FIG. 9) of the first transistor T1, and a gate electrode connected to the scan line GCLj. The first electrode of the third transistor T3 is also connected to the first terminal of the capacitor Cst. The third transistor T3 is turned on in response to the scan signal GCj transferred through the scan line GCLj to connect the gate electrode and the second electrode of the first transistor T1 to each other to diode-connect the first transistor T1.

The fourth transistor T4 includes a first electrode connected to the gate electrode of the first transistor T1, a second electrode connected to the third voltage line VL3 through which a first initialization voltage VINT is transferred, and a gate electrode connected to the scan line GILj. The first electrode of the fourth transistor T4 may also be connected to the first terminal of the capacitor Cst. The fourth transistor T4 is turned on in response to the scan signal GIj received through the scan line GILj and may perform initialization operation of initializing the voltage of the gate electrode of the first transistor T1, by transferring the first initialization voltage VINT to the gate electrode of the first transistor T1.

The fifth transistor T5 includes a first electrode connected to the first driving voltage line VL1, a second electrode connected to the first electrode of the first transistor T1, and a gate electrode connected to the emission control line EMLj.

The sixth transistor T6 includes a first electrode connected to the second electrode of the first transistor T1, a second electrode connected to the anode of the light emitting diode ED, and a gate electrode connected to the emission control line EMLj. The first electrode of the sixth transistor T6 may also be connected to the second electrode of the third transistor T3.

The fifth transistor T5 and the sixth transistor T6 are turned on at the same time in response to the emission signal EMj received through the emission control line EMLj, through which the first driving voltage ELVDD may be compensated through the diode-connected first transistor T1 and may be transferred to the light emitting diode ED.

The seventh transistor T7 includes a first electrode connected to the second electrode of the sixth transistor T6, a second electrode connected to the third voltage line VL3, and a gate electrode connected to the scan line GWLj+1. The seventh transistor T7 is turned on in response to the scan signal GWj+1 transferred through the scan line GWLj+1, and bypasses a current of the anode of the light emitting diode ED to the third voltage line VL3.

One end of the capacitor Cst is connected to the gate electrode of the first transistor T1, and the other end of the capacitor Cst is connected to the first driving voltage line VL1. In other words, a first end or first terminal of the capacitor Cst is connected to the gate electrode of the first transistor T1 and a second end or second terminal of the capacitor Cst is connected to the first driving voltage line VL1. One end of the capacitor Cboost is connected to the gate electrode of the first transistor T1, and the other end of the capacitor Cboost is connected to the scan line GWLj. In other words, a first end or first terminal of the capacitor Cboost is connected to the gate electrode of the first transistor T1 and a second end or second terminal of the capacitor Cboost is connected to the scan line GWLj.

A cathode of the light emitting diode ED may be connected to the second driving voltage line VL2 that transfers the second driving voltage ELVSS.

A structure of the pixel PXij according to an embodiment of the present disclosure is not limited to the structure illustrated in FIG. 5, and the number of transistors and the number of capacitors included in one pixel PXij, and the connection relationship may be variously modified.

Figure 6:
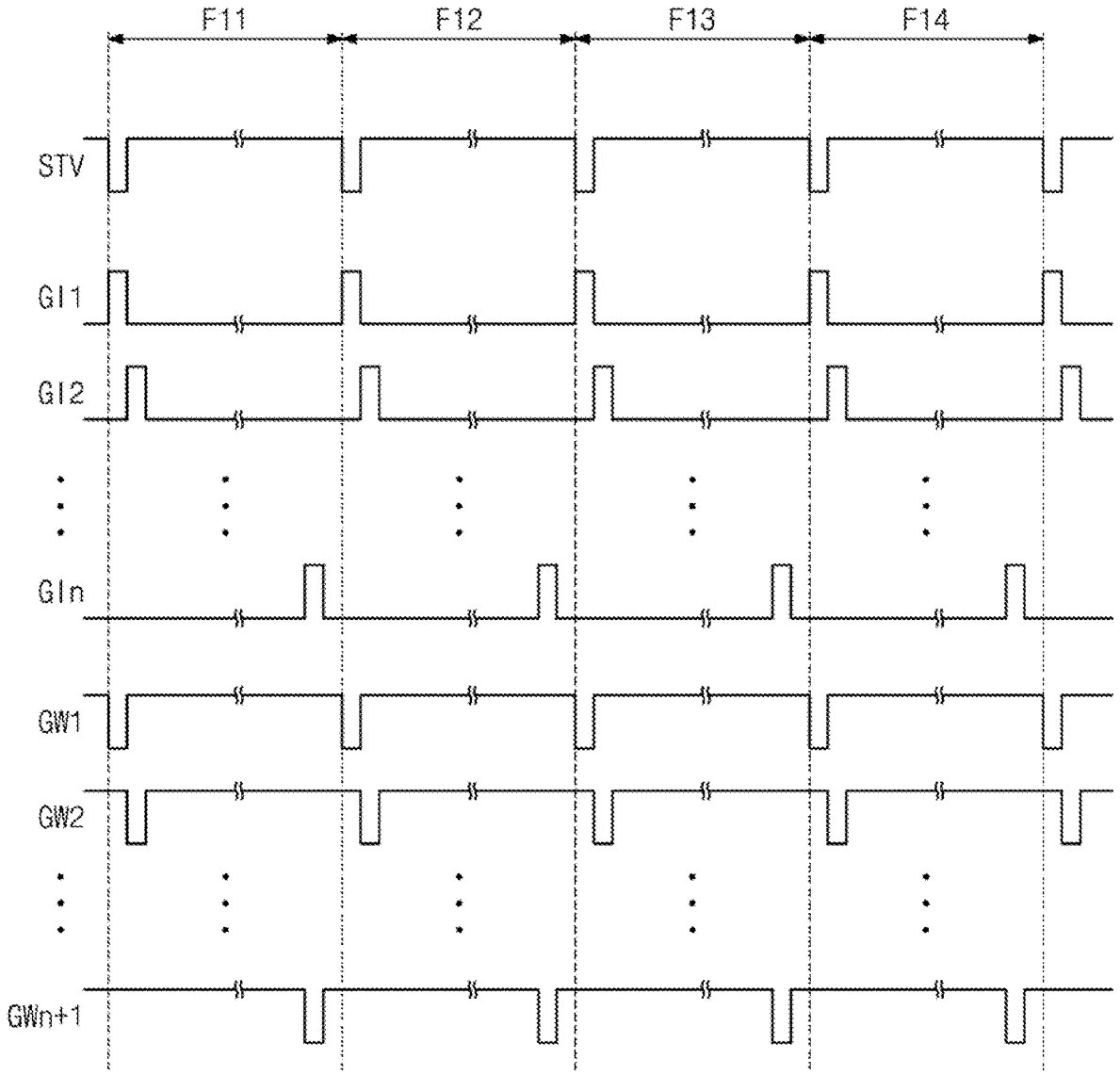
FIGS. 6 and 7 are timing diagrams for describing an operation of a display device.
Figure 7:
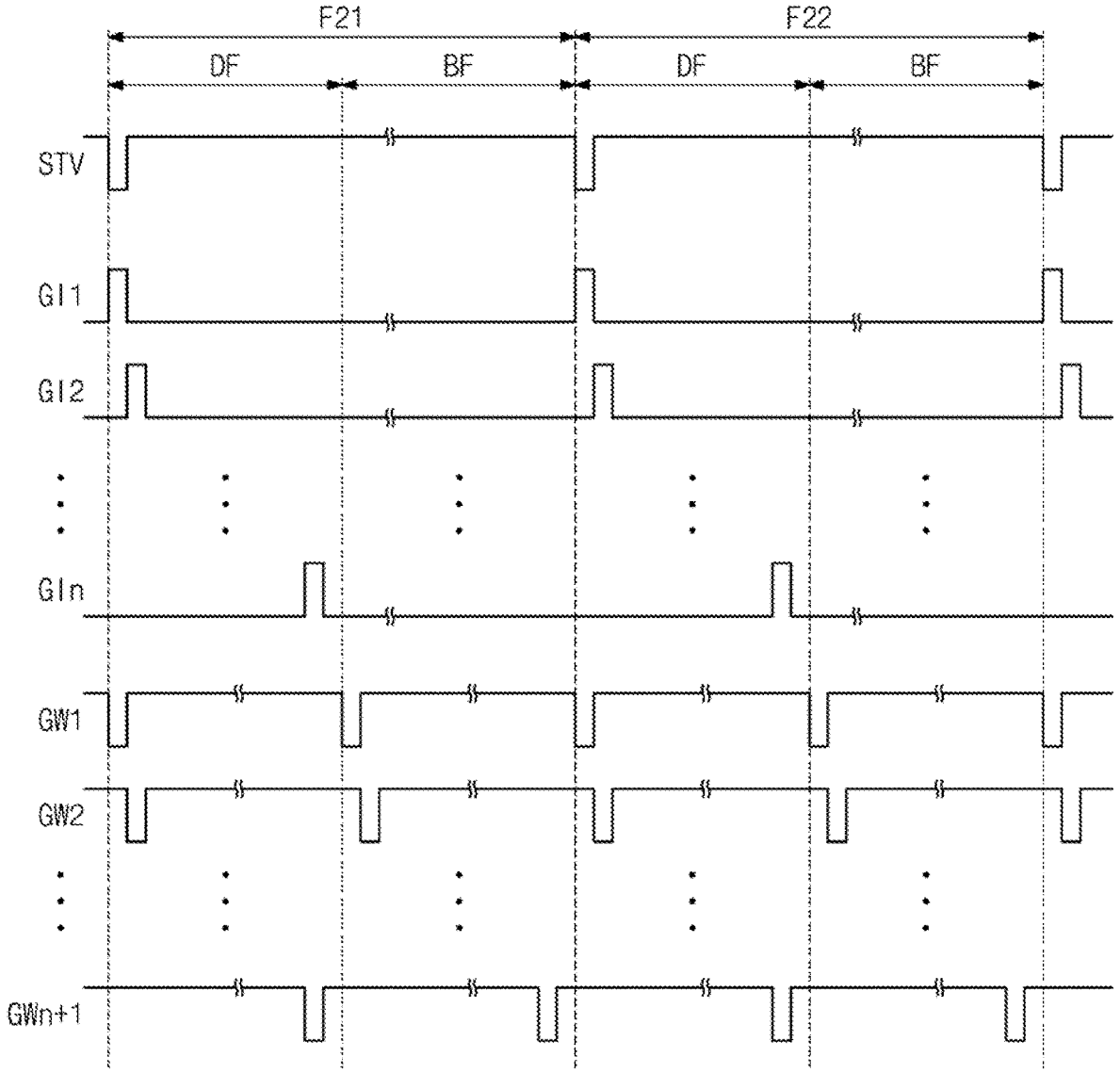

FIGS. 6 and 7 are timing diagrams for describing an operation of a display device according to an embodiment of the present disclosure.

Refer to FIGS. 4, 5, and 6, a driving frequency of the display device DD may be variously changed. For convenience of description, the display device DD is described as an example that operates at a first driving frequency (e.g., 120 Hz) and a second driving frequency (e.g., 60 Hz), but the present disclosure is not limited thereto. In an embodiment of the present disclosure, the driving frequency of the display device DD may be selected from one of the first driving frequency and the second driving frequency depending on a type of the image signal RGB. For example, when the image signal RGB is a moving image, the driving frequency of the display device DD may be selected as the first driving frequency. For example, when the image signal RGB is an image (e.g., a still image) having a long change period, the driving frequency of the display device DD may be selected as the second driving frequency.

The driving controller 100 provides the scan control signal SCS representing the driving frequency of the display device DD to the scan driving circuit SDC. The scan driving circuit SDC may include a start signal STV indicating the start of one frame.

FIG. 6 is a timing diagram of the start signal STV and gate signals when a driving frequency of the display device DD is the first driving frequency (e.g., 120 Hz).

Referring to FIGS. 4 and 6, when the driving frequency is a first driving frequency (e.g., 120 Hz), the start signal STV may be activated to a low level (or a high level) in the start of each of frames F11, F12, F13, and F14. The scan driving circuit SDC sequentially activates the scan signals GI1 to GIn to the high level in each of the frames F11, F12, F13, and F14 in response to the start signal STV, and sequentially activates the scan signals GW1 to GWn+1 to the low level in each of the frames F11. F12, F13, and F14 in response to the start signal STV. In FIG. 6, only the scan signals GI1 to GIn and the scan signals GW1 to GWn+1 are illustrated, but the scan signals GC to GCn and the emission signals EM1 to EMn may be sequentially activated in each of the frames F11, F12, F13, and F14.

FIG. 7 is a timing diagram of the start signal STV and gate signals when a driving frequency of the display device DD is a second driving frequency (e.g., 60 Hz).

Referring to FIGS. 4 and 7, when the driving frequency is the second driving frequency (e.g., 60 Hz), the start signal STV is activated to the low level at the start of each of the frames F21 and F22. A duration of each of the frames F21 and F22 may be twice the duration of each of the frames F11, F12, F13, and F14 illustrated in FIG. 6.

Each of the frames F21 and F22 may include one driving frame DF and one bias frame BE. The scan driving circuit SDC sequentially activates the scan signals GI1 to GIn and the scan signals GW1 to GWn+1 during the driving frame DF.

FIG. 7 illustrates only the scan signals GI1 to GIn and the scan signals GW1 to GWn+1, but the scan signals GC1 to GCn and the emission signals EM1 to EMn may be sequentially activated during the driving frame DF.

The scan driving circuit SDC maintains the scan signals GI1 to GIn in inactive state of the low level during the bias frame BF, and sequentially activates only the scan signals GW1 to GWn+1 to the low level during the bias frame BF.

The scan signals GC1 to GCn may also be maintained in an inactive state during the bias frame BF, and the emission signals EM1 to EMn may be sequentially activated to the low level.

In the example illustrated in FIG. 6, each of the frames F11, F12, F13, and F14 may correspond to the driving frame DF illustrated in FIG. 7.

A power consumption of the display device DD may be minimized by maintaining the scan signals GI1 to GIn and the scan signals GC1 to GCn at an inactive level (e.g., the low level) during the bias frame BF of the low frequency mode.

Figure 8:
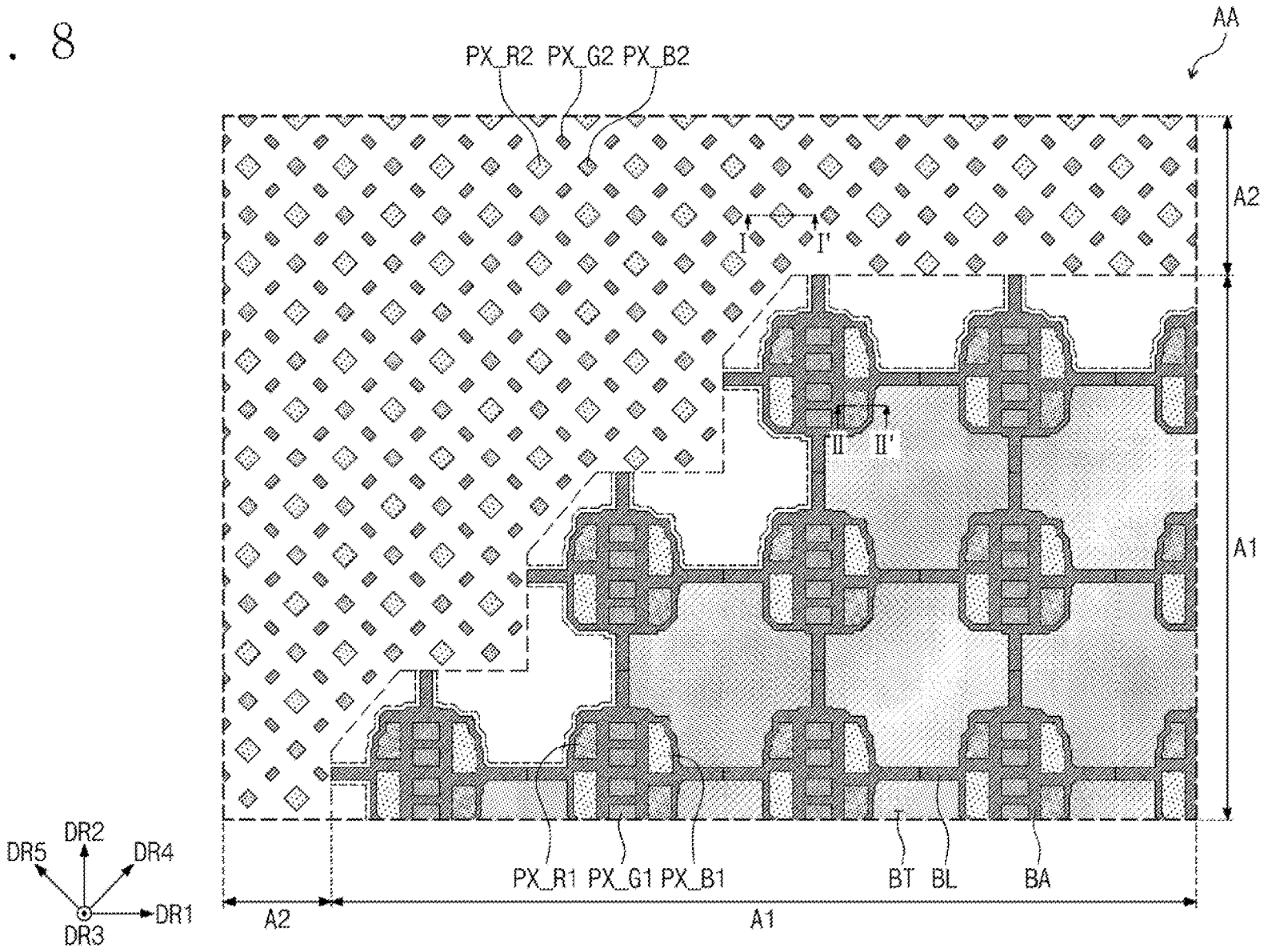
FIG. 8 is a plan view of an active area according to an embodiment of the present disclosure.
Figure 9:
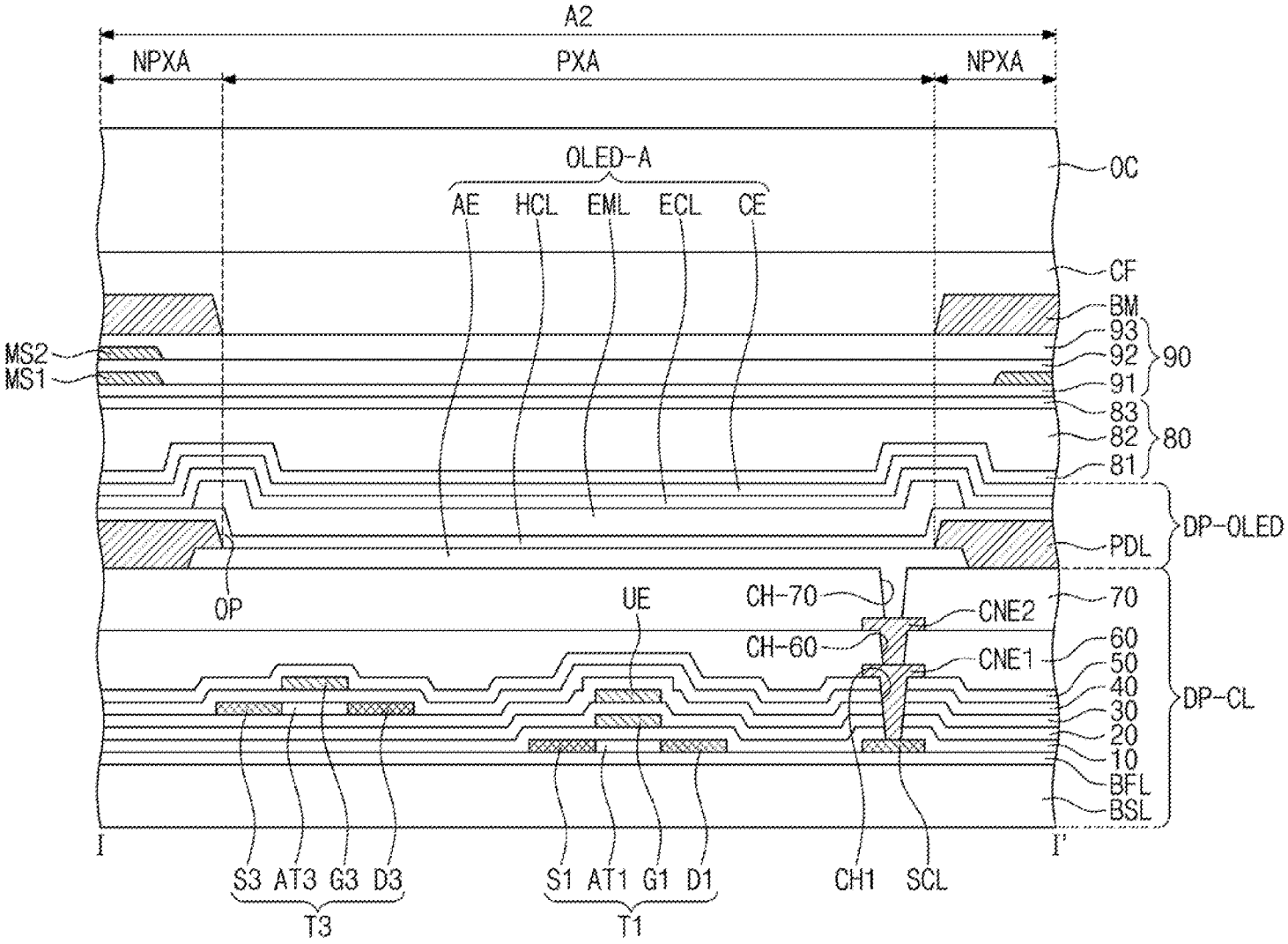
FIG. 9 is a cross-sectional view taken along line I-I' of FIG. 8.
Figure 10:
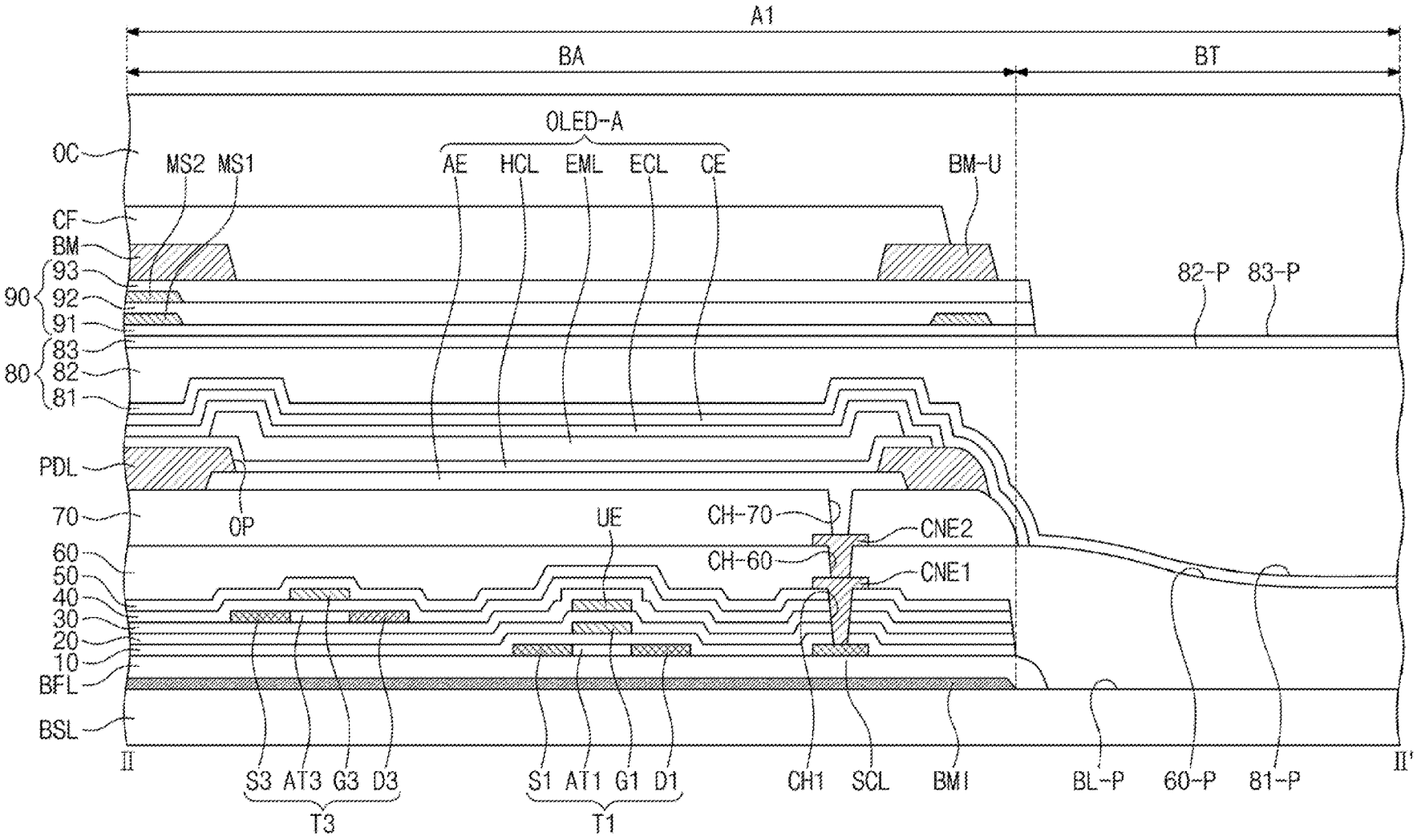
FIG. 10 is a cross-sectional view taken along line II-II' of FIG. 8.

FIG. 8 is a plan view of an active area according to an embodiment of the present disclosure. FIG. 9 is a cross-sectional view taken along line I-I' of FIG. 8. FIG. 10 is a cross-sectional view taken along line II-II' of FIG. 8.

Referring to FIG. 8, the display panel DP (refer to FIG. 3) according to the present disclosure may be divided into the first area A1 and the second area A2. In this embodiment, the first area A1 may be divided into a display area BA, a wiring area BL, and a transmissive area BT. Pixels PX_R1, PX_G1, and PX_B1 may be disposed in the display area BA of the first area A1. Pixels PX_R2, PX_G2, and PX_B2 may be disposed in the second area A2.

For convenience of description, the pixels PX_R1, PX_G1, and PX_B1 are respectively referred to as first to third pixels, and the pixels PX_R2, PX_G2, and PX_B2 are respectively referred to as fourth to sixth pixels.

The first pixel PX_R1 and the third pixel PX_B1 may be spaced apart from each other in the first direction DR1 with the second pixel PX_G1 interposed therebetween. In this embodiment, the first pixel PX_R1 may provide red light. In this embodiment, the second pixel PX_G1 may provide green light. In this embodiment, the third pixel PX_B1 may provide blue light.

In this embodiment, each of the first pixel PX_R1 and the third pixel PX_B1 may have an area greater than that of the second pixel PX_G1. In addition, the area of each of the first to third pixels PX_R1, PX_G1, and PX_B1 is large in the order of the second pixel PX_G1, the first pixel PX_R1, and the third pixel PX_B1. In other words, the first to third pixels PX_R1, PX_G1, and PX_B1 increase in size in the order of the second pixel PX_G1, the first pixel PX_R1, and the third pixel PX_B1. In addition, there are more pixels per unit area in the second area A2 than there are in the first area A1. A unit area may include a group of three different pixels. For example, in the second area A2, the unit area may include the fourth to sixth pixels PX_R2, PX_G2, and PX_B2.

The fourth pixel PX_R2 and the fifth pixel PX_G2 may be alternately disposed to be spaced apart from each other along the fourth direction DR4. The sixth pixel PX_B2 and the fifth pixel PX_G2 may be alternately disposed to be spaced apart from each other along the fifth direction DR5. In this embodiment, the fourth pixel PX_R2 may provide red light. In this embodiment, the fifth pixel PX_G2 may provide green light. In this embodiment, the sixth pixel PX_B2 may provide blue light. In this embodiment, the arrangement structure of the fourth to sixth pixels PX_R2, PX_G2, and PX_B2 disposed in the second area A2 may be referred to as a PENTILE™ structure.

In this embodiment, each of the fourth pixel PX_R2 and the sixth pixel PX_B2 may have an area greater than that of the fifth pixel PX_G2.

Each of the first to third pixels PX_R1, PX_G1, and PX_B1 is greater than an area of a pixel of a corresponding color among the fourth to sixth pixels PX_R2, PX_G2, and PX_B2. For example, the number of the first to third pixels PX_R1, PX_G1, and PX_B1 per unit area of the first area A1 is less than the number of the fourth to sixth pixels PX_R2, PX_G2, and PX_B2 per unit area of the second area A2.

The display area BA and the wiring area BL are areas in which conductive materials forming the first to third pixels PX_R1, PX_G1, and PX_B1 are patterned, and when the electronic module EM transmits/receives light, the light reflected by the conductive materials may degrade the performance of the electronic module EM (refer to FIG. 2). The first area A1 overlapping the electronic module EM may include the transmissive area BT so that light transmission/reception efficiency of the electronic module EM may be improved.

FIGS. 9 and 10 illustrate cross-sections of portions corresponding to the first transistor T1 and the third transistor T3 among the first to seventh transistors T1 to T7 described with reference to FIG. 5. FIG. 9 illustrates a cross-section of a portion corresponding to the first transistor T1 and the third transistor T3 of the fourth pixel PX_R2 among the fourth to sixth pixels PX_R2, PX_G2, and PX_B2. FIG. 10 illustrates a cross-section of a portion corresponding to the first transistor T1 and the third transistor T3 of the first pixel PX_R1 among the first to third pixels PX_R1, PX_G1, and PX_B1.

First, referring to FIG. 9, the display panel DP may include a circuit element layer DP-CL, a display element layer DP-OLED, and a thin film encapsulation layer 80. The display panel DP may further include a black matrix BM, a color filter CF, and an overcoat layer OC disposed in an area overlapping the second area A2.

The display panel DP may further include functional layers such as an anti-reflection layer and a refractive index adjusting layer. The circuit element layer DP-CL includes at least a plurality of insulating layers and a circuit element. Hereinafter, the insulating layers may include an organic layer and/or an inorganic layer.

The insulating layer, the semiconductor layer and the conductive layer are formed by methods such as coating, deposition, etc. Thereafter, the insulating layer, the semiconductor layer, and the conductive layer may be selectively patterned by a photolithography method. In this way, a semiconductor pattern, a conductive pattern, a signal line, etc. are formed.

A base layer BSL may include a synthetic resin film. The synthetic resin film may include a thermosetting resin. In particular, the synthetic resin film may be a polyimide-based resin layer, and the material thereof is not particularly limited. The synthetic resin film may include at least one of acrylic resins, methacrylic resins, polyisoprene, vinyl resins, epoxy resins, urethane resins, cellulose resins, siloxane resins, polyamide resins, and perylene resins. In addition, the base layer BSL may include a glass substrate, a metal substrate, or an organic/inorganic composite material substrate.

The base layer BSL may be provided in a form in which organic layers and inorganic layers are alternately stacked. For example, a first organic layer including a polyimide, a first inorganic layer, a second organic layer including the polyimide, and a second inorganic layer may be provided in an alternately stacked structure, and the present disclosure is not limited to any one embodiment.

At least one inorganic layer is formed on an upper surface of the base layer BSL. The inorganic layer may include at least one of an aluminum oxide layer, a titanium oxide layer, a silicon oxide layer, a silicon nitride layer, a silicon oxynitride layer, a zirconium oxide layer, and a hafnium oxide layer. The inorganic layer may be formed in multiple layers. The multi-layered inorganic layers may form a barrier layer and/or a buffer layer BFL, which will be described later. The barrier layer and the buffer layer BFL may be selectively disposed.

The buffer layer BFL may be disposed on the base layer BSL. The buffer layer BFL improves a bonding force between the base layer BSL and the semiconductor pattern and/or the conductive pattern. The buffer layer BFL may include a silicon oxide layer and a silicon nitride layer. In addition, the silicon oxynitride layer may have a single layer or multilayer structure, and is not limited to one embodiment.

A semiconductor pattern is disposed on the buffer layer BFL. Hereinafter, the semiconductor pattern directly disposed on the buffer layer BFL is referred to as a first semiconductor pattern. The first semiconductor pattern may include a silicon semiconductor. The first semiconductor pattern may include polysilicon. However, the present disclosure is not limited thereto, and the first semiconductor pattern may include amorphous silicon.

FIG. 9 illustrates only a portion of the first semiconductor pattern, and the first semiconductor pattern may be further disposed in another portion of the fourth pixel PX_R2 (refer to FIG. 8). The first semiconductor pattern has different electrical properties depending on whether it is doped or not. The first semiconductor pattern may include a doped region and a non-doped region. The doped region may be doped with an N-type dopant or a P-type dopant. A P-type transistor includes a doped region doped with the P-type dopant, and an N-type transistor includes a doped region doped with the N-type dopant.

The source S1, an active AT1, and the drain D1 of the first transistor T1 are formed of the first semiconductor pattern. The source S1 and the drain D1 of the first transistor T1 are formed to be spaced apart from each other with the active AT1 interposed therebetween. For example, the active AT1 may be in contact with each of the source S1 and the drain D1.

A connection signal line SCL may be disposed on the buffer layer BFL. The connection signal line SCL may be connected to a drain of the sixth transistor T6 (refer to FIG. 5) on a plane.

A light blocking layer BMI is disposed on the buffer layer BFL, and the buffer layer BFL may be covered with a first insulating layer 10. The first insulating layer 10 may be an inorganic layer and/or an organic layer, and may have a single layer or multilayer structure. The first insulating layer 10 may include at least one of an aluminum oxide layer, a titanium oxide layer, a silicon oxide layer, a silicon nitride layer, a silicon oxynitride layer, a zirconium oxide layer, and a hafnium oxide layer.

In this embodiment, the first insulating layer 10 is disposed on the buffer layer BFL and covers the first semiconductor pattern and the connection signal line SCL. In this embodiment, the first insulating layer 10 may be a single-layer silicon oxide layer. In addition to the first insulating layer 10, the insulating layer of the circuit element layer DP-CL to be described later may be an inorganic layer and/or an organic layer, and may have a single layer or multilayer structure. The inorganic layer may include at least one of the above-described materials.

A gate G1 of the first transistor T1 is disposed on the first insulating layer 10. The gate G1 may be a portion of a metal pattern. The gate G1 of the first transistor T1 overlaps the active AT1 of the first transistor T1. In the process of doping the first semiconductor pattern, the gate G1 of the first transistor T1 serves as a mask.

A second insulating layer 20 covering the gate G1 is disposed on the first insulating layer 10. The second insulating layer 20 may be an inorganic layer and/or an organic layer, and may have a single layer or multilayer structure. In this embodiment, the second insulating layer 20 may be an inorganic layer and/or an organic layer, and may have a single layer or multilayer structure. In this embodiment, the second insulating layer 20 may be a single-layer silicon nitride layer.

An upper electrode UE may be disposed on the second insulating layer 20. The upper electrode UE may overlap the gate G1. The upper electrode UE may be a portion of the metal pattern or a portion of a doped semiconductor pattern. A portion of the gate G1 and the upper electrode UE overlapping the portion of the gate G1 may define the capacitor Cst (refer to FIG. 5). In an embodiment of the present disclosure, the upper electrode UE may be omitted.

In an embodiment of the present disclosure, the second insulating layer 20 may be replaced with an insulating pattern. The upper electrode UE is disposed on the insulating pattern. The upper electrode UE may serve as a mask for forming an insulating pattern from the second insulating layer 20.

A first electrode and a second electrode of the capacitor Cst (refer to FIG. 5) may be formed through the same process as that of the gate G1 and the upper electrode UE. The first electrode may be disposed on the first insulating layer 10. The first electrode may be electrically connected to the gate G1. The first electrode may have a shape integral with the gate G1.

A third insulating layer 30 covering the upper electrode UE is disposed on the second insulating layer 20. In this embodiment, the third insulating layer 30 may include a plurality of silicon oxide layers and silicon nitride layers that are alternately stacked. The first electrodes, the second electrodes, and the gate electrodes of the second, fifth, sixth, and seventh transistors T2, T5, T6, and T7 (refer to FIG. 5) may be formed through the same process as the source S1, the drain D1, and the gate G1 of the first transistor T1, respectively.

A semiconductor pattern is disposed on the third insulating layer 30. Hereinafter, a semiconductor pattern directly disposed on the third insulating layer 30 is referred to as a second semiconductor pattern. The second semiconductor pattern may include a metal oxide. An oxide semiconductor may include a crystalline or amorphous oxide semiconductor.

For example, the oxide semiconductor may include a metal oxide such as zinc (Zn), indium (in), gallium (Ga), tin (Sn), and titanium (Ti), or a mixture of a metal such as zinc (Zn), indium (In), gallium (Ga), tin (Sn), and titanium (Ti)

and oxides thereof. The oxide semiconductor may include indium-tin oxide (ITO), indium-gallium-zinc oxide (IGZO), zinc oxide (ZnO), indium-zinc oxide (IZnO), zinc-indium oxide (ZIO), indium oxide (InO), titanium oxide (TiO), indium-zinc-tin oxide (IZTO), zinc-tin oxide (ZTO), etc.

As illustrated in FIG. 9, the source S3, an active AT3, and the drain D3 of the third transistor T3 are formed of the second semiconductor pattern. In other words, the third transistor T3 is disposed at a level higher than the first transistor T1. The source S3 and the drain D3 contain metal reduced from the metal oxide semiconductor. The source S3 and the drain D3 may have a predetermined thickness from an upper surface of the second semiconductor pattern, and may include a metal layer including the reduced metal.

A fourth insulating layer 40 covering the second semiconductor pattern is disposed on the third insulating layer 30. In this embodiment, the fourth insulating layer 40 may be a single-layer silicon oxide layer. A gate G3 of the third transistor T3 is disposed on the fourth insulating layer 40. The gate G3 may be a portion of the metal pattern. The gate G3 of the third transistor T3 overlaps the active AT3 of the third transistor T3.

In an embodiment of the present disclosure, the fourth insulating layer 40 may be replaced with an insulating pattern. The gate G3 of the third transistor T3 is disposed on the insulating pattern. In the present embodiment, the gate G3 may have the same shape as the insulating pattern on a plane.

A fifth insulating layer 50 covering the gate G3 is disposed on the fourth insulating layer 40. In this embodiment, the fifth insulating layer 50 may include a silicon oxide layer and a silicon nitride layer. The fifth insulating layer 50 may include a plurality of silicon oxide layers and silicon nitride layers that are alternately stacked.

The first electrode, the second electrode, and the gate electrode of the fourth transistor T4 (refer to FIG. 5) may be formed through the same process as the source S3, the drain D3, and the gate G3 of the third transistor T3, respectively.

At least one insulating layer is further disposed on the fifth insulating layer 50. As in the present embodiment, a sixth insulating layer 60 and a seventh insulating layer 70 may be disposed on the fifth insulating layer 50. The sixth insulating layer 60 and the seventh insulating layer 70 may be an organic layer and may have a single layer or multilayer structure. The sixth insulating layer 60 and the seventh insulating layer 70 may be a single polyimide-based resin layer.

Not limited thereto, the fifth insulating layer 50 and the sixth insulating layer 60 may include at least one of acrylic-based resin, methacrylic-based resin, polyisoprene-based resin, vinyl-based resin, epoxy-based resin, urethane-based resin, cellulose-based resin, siloxane-based resin, a polyamide-based resin, and a perylene-based resin.

A first connection electrode CNE1 may be disposed on the fifth insulating layer 50. The first connection electrode CNE1 may be connected to the connection signal line SCL (or a connection electrode) through a first contact hole CH1 passing through the first to fifth insulating layers 10 to 50.

A second connection electrode CNE2 may be disposed on the sixth insulating layer 60. The second connection electrode CNE2 is connected to the first connection electrode CNE1 through a second contact hole CH-60 passing through the sixth insulating layer 60. The second contact hole CH-60 and the first contact hole CH1 are aligned in a vertical direction, for example.

A light emitting diode OLED-A is disposed on the seventh insulating layer 70. An anode or first electrode AE of the light emitting diode OLED-A is disposed on the seventh insulating layer 70. A pixel defining layer PDL is disposed on the seventh insulating layer 70. An opening OP exposing at least a portion of the first electrode AE may be provided in the pixel defining layer PDL. In the present embodiment, the pixel defining layer PDL may include a light absorbing material. For example, the pixel defining layer PDL may have a black color. The pixel defining layer PDL may overlap portions of the first electrode AE of the light emitting diode OLED-A.

The first to seventh transistors T1 to T7 (refer to FIG. 5) connected to the light emitting diode OLED-A may form one second pixel PXij (refer to FIG. 4).

The opening OP of the pixel defining layer PDL may define an emission area PXA. In other words, the emission area PXA is provided in the opening OP of the pixel defining layer PDL. For example, the plurality of pixels PX (refer to FIG. 4) may be arranged on a plane of the display panel DP (refer to FIG. 4) in a uniform rule. An area in which the plurality of pixels PX are disposed may be referred to as a pixel area, and one pixel area may include the emission area PXA and a non-emission area NPXA adjacent to the emission area PXA. The non-emission area NPXA may surround the emission area PXA.

The first electrode AE is disposed on the seventh insulating layer 70. The first electrode AE is connected to the second connection electrode CNE2 through a third contact hole CH-70 passing through the seventh insulating layer 70. The third contact hole CH-70 may be aligned in the vertical direction with the second contact hole CH-60. The second connection electrode CNE2 may be provided at a lower portion of the seventh insulating layer 70.

A hole control layer HCL may be commonly disposed in the emission area PXA and the non-emission area NPXA. A common layer such as the hole control layer HCL may be commonly formed on the plurality of pixels PXij. The hole control layer HCL may include a hole transport layer and a hole injection layer.

An emission layer EML is disposed on the hole control layer HCL. The emission layer EML may be disposed only in an area corresponding to the opening OP. The emission layer EML may be formed separately in each of the plurality of pixels PX.

Although a patterned emission layer EML is illustrated as an example in the present embodiment, the emission layer EML may be commonly disposed on the plurality of pixels PX. In this case, the emission layer EML may generate white light or blue light. In addition, the emission layer EML may have a multilayer structure.

An electronic control layer ECL is disposed on the emission layer EML. The electron control layer ECL may include an electron transport layer and an electron injection layer. A second electrode CE is disposed on the electronic control layer ECL. In the opening, the second electrode CDE may function as a cathode of the light emitting diode OLED-A. The electronic control layer ECL and the second electrode CE are commonly disposed on the plurality of pixels PX.

The thin film encapsulation layer 80 is disposed on the second electrode CE. The thin film encapsulation layer 80 is commonly disposed on the plurality of pixels PX. In this embodiment, the thin film encapsulation layer 80 directly covers the second electrode CE.

The thin film encapsulation layer 80 may include a first inorganic layer 81, an organic layer 82, and a second inorganic layer 83. However, the present disclosure is not limited thereto, and the thin film encapsulation layer 80 may further include a plurality of inorganic layers and organic layers.

The first inorganic layer 81 may contact the second electrode CE. For example, the first inorganic layer 81 may directly contact the second electrode CE. The first inorganic layer 81 may prevent external moisture or oxygen from penetrating into the emission layer EML. For example, the first inorganic layer 81 may include a silicon nitride layer, a silicon oxide layer, or a combination thereof. The first inorganic layer 81 may be formed through a deposition process.

The organic layer 82 may be disposed on the first inorganic layer 81 to contact the first inorganic layer 81. For example, the first inorganic layer 81 may directly contact the first inorganic layer 81. The organic layer 82 may provide a flat surface on the first inorganic layer 81. Since curves formed on the upper surface of the first inorganic layer 81 or particles present on the first inorganic layer 81 are covered by the organic layer 82, an influence of the surface state of the upper surface of the first inorganic layer 81 on the components formed on the organic layer 82 may be blocked. The organic layer 82 may include an organic material and may be formed through a solution process such as spin coating, slit coating, or inkjet process.

The second inorganic layer 83 is disposed on the organic layer 82 to cover the organic layer 82. The second inorganic layer 83 may be stably formed on a relatively flat surface than that disposed on the first inorganic layer 81. The second inorganic layer 83 seals moisture emitted from the organic layer 82 and prevents it from flowing to the outside. The second inorganic layer 83 may include a silicon nitride layer, a silicon oxide layer, or a combination thereof. The second inorganic layer 83 may be formed through a deposition process.

An input sensor 90 may be directly formed on the thin film encapsulation layer 80. The input sensor 90 may be a sensor for sensing an input such as a user's touch or pressure. The input sensor 90 may include a plurality of first and second conductive patterns MS1 and MS2 and a sensing insulating layer. The sensing insulating layer may include a first sensing insulating layer 91, a second sensing insulating layer 92, and a third sensing insulating layer 93.

The first sensing insulating layer 91 is disposed on the thin film encapsulation layer 80. For example, the first sensing insulating layer 91 is in direct contact with the second inorganic layer 83. The first conductive patterns MS1 may be disposed on the first sensing insulating layer 91 and may be covered by the second sensing insulating layer 92. The second conductive patterns MS2 may be disposed on the second sensing insulating layer 92 and may be covered by the third sensing insulating layer 93.

Each of the first and second conductive patterns MS1 and MS2 has conductivity. Each of the first and second conductive patterns MS1 and MS2 may be provided as a single layer or as a plurality of layers, but is not limited to any one embodiment. The first and second conductive patterns MS1 and MS2 may overlap each other at one side of the opening OP and only one of the first and second conductive patterns MS1 and MS2 may be disposed at another side of the opening OP. At least one of the first and second conductive patterns MS1 and MS2 according to the present disclosure may be provided as mesh lines on a plane.

The mesh lines constituting the first and second conductive patterns MS1 and MS2 may be spaced apart from the emission layer EML on a plane. Accordingly, even if the input sensor 90 is directly formed on the display panel DP, the light generated from the pixels PX (refer to FIG. 4) of the display panel DP will be provided to a user without interference from the input sensor 90.

The color filter CF may overlap the emission layer EML. The color filter CF may selectively transmit light corresponding to the light provided from the emission layer EML. For example, when the emission layer EML provides blue light, the color filter CF may be a blue color filter that transmits blue light.

The color filter CF may include a polymer photosensitive resin and a pigment or dye. For example, the color filter CF overlapping the emission layer EML providing blue light may include a blue pigment or a blue dye, the color filter CF overlapping the emission layer EM L providing green light may include a green pigment or a green dye, and the color filter CF overlapping the emission layer EML providing red light may include a red pigment or a red dye.

However, the present disclosure is not limited thereto, and the color filter CF overlapping the emission layer EML providing blue light may not include a pigment or dye. In this case, the color filter CF may be transparent, and the color filter CF may be formed of a transparent photosensitive resin.

The black matrix BM may be disposed between color filters providing different light. The black matrix BM is a pattern having a black color and may be a grid-shaped matrix. The black matrix BM may include a black coloring agent. The black coloring agent may include a black dye and a black pigment. The black coloring agent may include a metal such as carbon black or chromium, or an oxide thereof.

The overcoat layer OC may be disposed on the color filter CF and the black matrix BM. The overcoat layer OC may be a layer that surrounds irregularities generated during the formation of the color filter CF and the black matrix BM and provides a flat surface. In other words, the overcoat layer OC may be a planarization layer.

FIG. 10 is a cross-sectional view of a portion of each of the display area BA and the transmissive area BT of the first area A1 in which the electronic module EM (refer to FIG. 2) and the display panel DP (refer to FIG. 2) overlap.

The first pixel PX_R1 (refer to FIG. 8) disposed in the first area A1 is composed of first to seventh transistors T1 to T7 (refer to FIG. 5) connected to a light emitting diode OLED-A, and a stacking relationship of the first to third pixels PX_R1, PX_G1, and PX_B1 may be the same as that of the fourth pixel PX_R2 disposed in the second area A2 described with reference to FIG. 9.

In this embodiment, the light blocking layer BMI may be disposed in the display area BA of the first area A1. For example, the light blocking layer BMI may overlap the display area BA of the first area A1 and may not overlap the transmissive area BT. In other words, the light blocking layer BMI of this embodiment may not be provided in the transmissive area BT. The light blocking layer BMI may be disposed between the base layer BSL and the buffer layer BFL. The light blocking layer BMI may include a metal.

However, when a barrier layer is further included between the base layer BSL and the buffer layer BFL, the light blocking layer BMI may be disposed in at least one of between the base layer BSL and the barrier layer and between the barrier layer and the buffer layer BFL, but is not limited to any one embodiment.

The light blocking layer BMI is disposed on the base layer BSL to prevent conductive materials disposed on the base layer BSL from being viewed by the electronic module EM (refer to FIG. 2) by external light. Accordingly, the light transmittance in the active area AA is improved, and accordingly, even when the electronic module EM is disposed inside the active area AA (refer to FIG. 2), the performance of the electronic module EM is improved in the display device (DD, refer to FIG. 2).

The transmissive area BT of the first area A1 may be surrounded by the display area BA and the wiring area BL. The transmissive area BT may be an area in which conductive materials or insulating layers are patterned or are not deposited to improve light transmittance.

In this embodiment, the transmissive area BT may have a cross shape. However, the present disclosure is not limited thereto, and the shape of the transmissive area BT may vary depending on the shape in which the light blocking layer BMI is disposed, and is not limited to any one shape.

The transmissive area BT according to the present disclosure may be formed by omitting insulating layers overlapping the transmissive area BT among the first to seventh insulating layers 10 to 70.

In this embodiment, among the first to seventh insulating layers 10 to 70 included in the display panel DP, the first insulating layer 10, the second insulating layer 20, the third insulating layer 30, the fourth insulating layer 40, the fifth insulating layer 50, and the seventh insulating layer 70 may not be deposited in the transmissive area BT or are removed by being patterned after deposition. In this case, the sixth insulating layer 60 may be the only insulating layer of the first to seventh insulating layers 10 to 70 be included in the transmissive area BT.

In addition, a portion of the first to third sensing insulating layers 91, 92, and 93 overlapping the transmissive area BT among the first to third sensing insulating layers 91, 92, and 93 may not be deposited in the transmissive area BT or removed by patterning after deposition. Accordingly, the first to third sensing insulating layers 91, 92, and 93 adjacent to the transmissive area BT may be collectively etched to provide a step formed in each side surface.

In the present embodiment, a base layer portion BL-P, a sixth insulating layer portion 60-P, a first inorganic layer portion 81-P, and an organic layer portion 82-P, a second inorganic layer portion 83-P, and an overcoat layer OC covering the second inorganic layer portion 83-P may be disposed in the transmissive area BT.

Accordingly, the light blocking layer BMI, the buffer layer BFL, the first to fifth insulating layers 10 to 50, the seventh insulating layer 70, the first sensing insulating layer 91, the second sensing insulating layer 92, the third sensing insulating layer 93, the color filter CF, and the black matrix BM that overlap the display area BA may not overlap the transmissive area BT. In addition, components of the light emitting diode OLED-A may also not overlap the transmissive area BT.

According to the present embodiment, an upper surface BM-U of the black matrix BM disposed adjacent to the transmissive area BT of the black matrix BM is exposed by the color filter CF and may be in contact with the overcoat layer OC. In other words, a part of the upper surface BM-U of the black matrix BM may be in contact with the color filter CF and another part of the back matrix BM may be in contact with the overcoat layer OC.

According to the present disclosure, the first area A1 has a higher light transmittance than the second area A2, and the transmissive area BT disposed between the first pixels PX_R1 of the first area A1 may have the highest light transmittance.

In this embodiment, since the display panel DP in which some of the insulating layers are removed in an area overlapping the electronic module EM is included, the display panel DP having improved light transmittance may be provided. Accordingly, even if the electronic module EM is disposed inside the active area AA (refer to FIG. 2), it is possible to prevent the deterioration of the light sensing performance of the electronic module EM.

Figure 11:
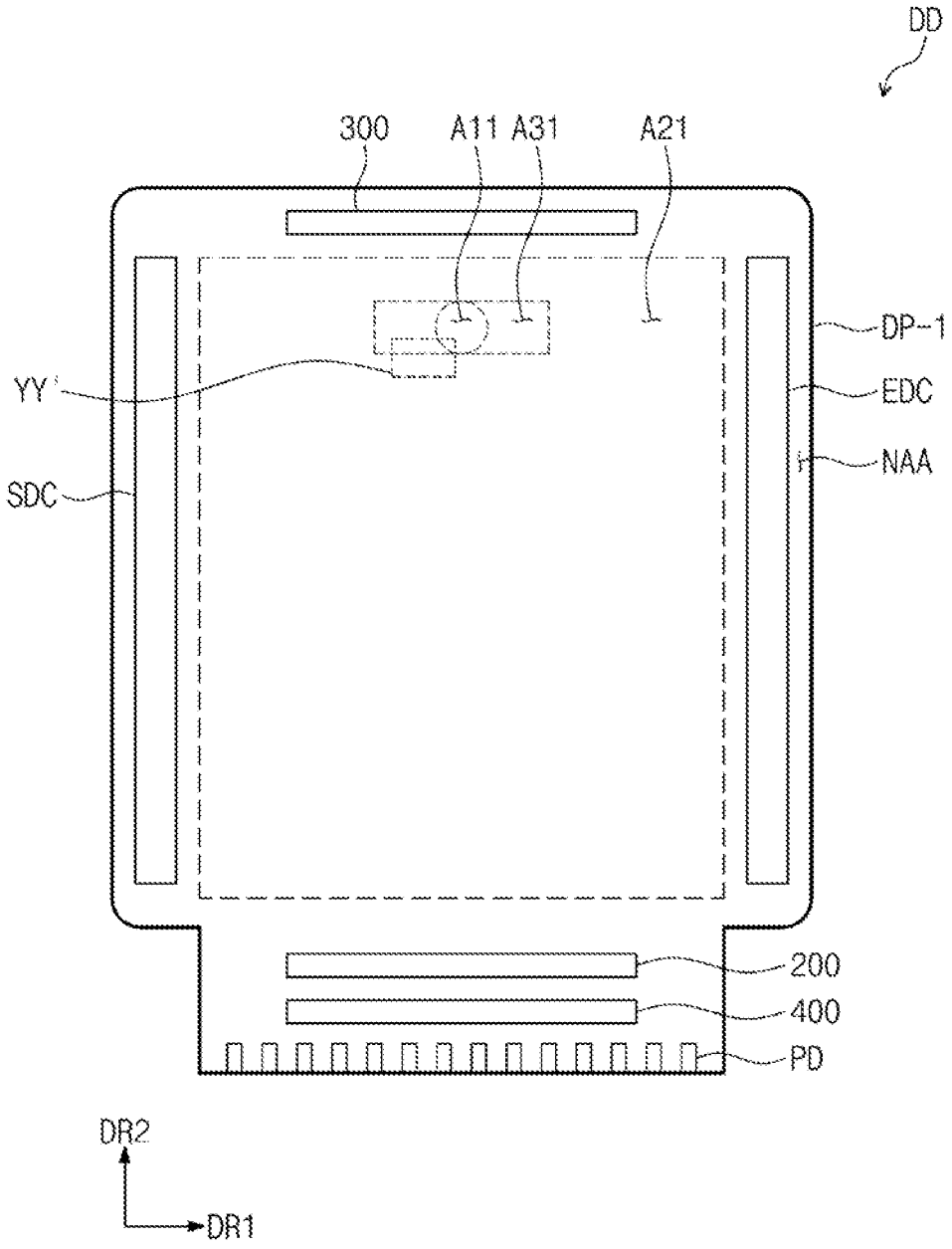
FIG. 11 is a plan view of a display panel according to an embodiment of the present disclosure.
Figure 12:
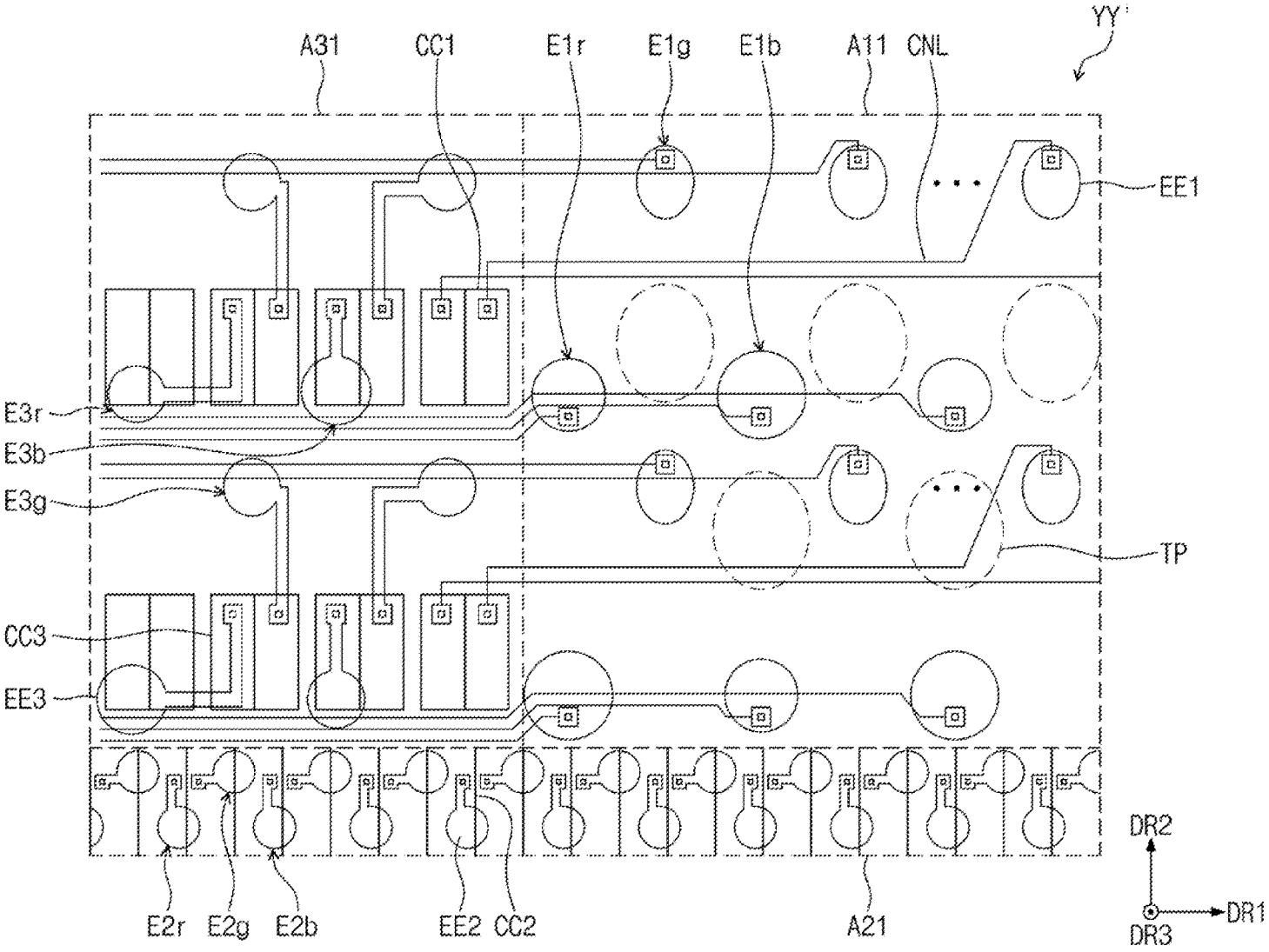
FIG. 12 is a plan view illustrating an enlarged region YY' of FIG. 11.

FIG. 11 is a plan view of a display panel according to an embodiment of the present disclosure. FIG. 12 is a plan view illustrating an enlarged region YY' of FIG. 11.

Referring to FIGS. 11 and 12, a display panel DP-1 may further include a first area A11, a second area A21, and a third area A31 between the first area A11 and the second area A21.

The first area A11 may be provided in an area overlapping the electronic module EM (refer to FIG. 2) on a plane. In the present embodiment, the first area A11 is illustrated in a circular shape, but may have various shapes such as a polygon, an ellipse, or a figure having at least one curved side, and is not limited to any one embodiment. The third area A31 is adjacent to the first area A11. The third area A31 may surround at least a portion of the first area A11.

The third area A31 may be spaced apart from the peripheral area NAA. Accordingly, the third area A31 may be completely surrounded by the second area A21. However, the present disclosure is not limited thereto, and the third area A31 may be in contact with the peripheral area NAA. In this case, the second area A21 may surround only a part of the third area A31.

A resolution of the third area A31 is less than that of the second area A21. The resolution of the third area A31 may be actually the same as the resolution of the first area A11, or may be greater than the resolution of the first area A11. A transmittance of the third area A31 is less than that of the first area A11. The transmittance of the third area A31 may be greater than that of the second area A21 or may be actually equal to the transmittance of the second area A21.

The display panel DP-1 may include first pixels E1*r*, E1*g*, and E1*b*, second pixels E2*r*, E2*g*, and E2*b*, and third pixels E3*r*, E3*g*, and E3*b*. The first pixels E1*r*, E1*g*, and E1*b* may be referred to as the first red pixel E1*r*, the first green pixel E1*g*, and the first blue pixel E1*b*. The second pixels E2*r*, E2*g*, and E2*b* may be referred to as the second red pixel E2*r*, the second green pixel E2*g*, and the second blue pixel E2*b*. The third pixels E3*r*, E3*g*, and E3*b* may be referred to as the third red pixel E3*r*, the third green pixel E3*g*, and the third blue pixel E3*b*.

Each of the first pixels E1*r*, E1*g*, and E1*b* may include a first light emitting device EE1 and a first pixel circuit CC1 for driving the first light emitting device EE1. Each of the second pixels E2*r*, E2*g*, and E2*b* may include a second light emitting device EE2 and a second pixel circuit CC2 for driving the second light emitting device EE2. Each of the third pixels E3*r*, E3*g*, and E3*b* may include a third light emitting device EE3 and a third pixel circuit CC3 for driving the third light emitting device EE3.

The first light emitting device EE1 may be disposed in the first area A11, the second light emitting device EE2 may be disposed in the second area A21, and the third light emitting device EE3 may be disposed in the third area A31. The first pixel circuit CC1 may be disposed in the third area A31 or the peripheral area NAA. The second pixel circuit CC2 may be disposed in the second area A21. The third pixel circuit CC3 may be disposed in the third area A31.

The first area A11 may be an area overlapping the electronic module EM. The first pixel circuit CC1 for driving the first light emitting device EE1 disposed in the first area A11 is disposed in an area other than the first area A11, for example, the third area A31 or the peripheral area NAA. In other words, since the first pixel circuit CC1 is not disposed in the first area A11, an area of a transmission part TP may be easily expanded, and thus light transmittance may be further improved.

The first light emitting device EE1 and the first pixel circuit CC1 may be electrically connected to each other through a connection line CNL. The connection line CNL may overlap the transmission parts TP. The connection line CNL may include a transparent conductive wiring. The transparent conductive wiring may include a transparent conductive material. For example, the transparent conductive wiring may be formed of a transparent conductive oxide (TCO) layer such as IGZO, ITO, IZO, ZnO, or $In_2O_3$.

The third area A31 does not include the transmission parts TP, but the first pixel circuit CC1 may be disposed in the third area A31. Accordingly, the number of third light emitting devices EE3 disposed in the third area A31 per unit area may be less than the number of second light emitting devices EE2 disposed in the second area A21 per unit area.

Figure 13:
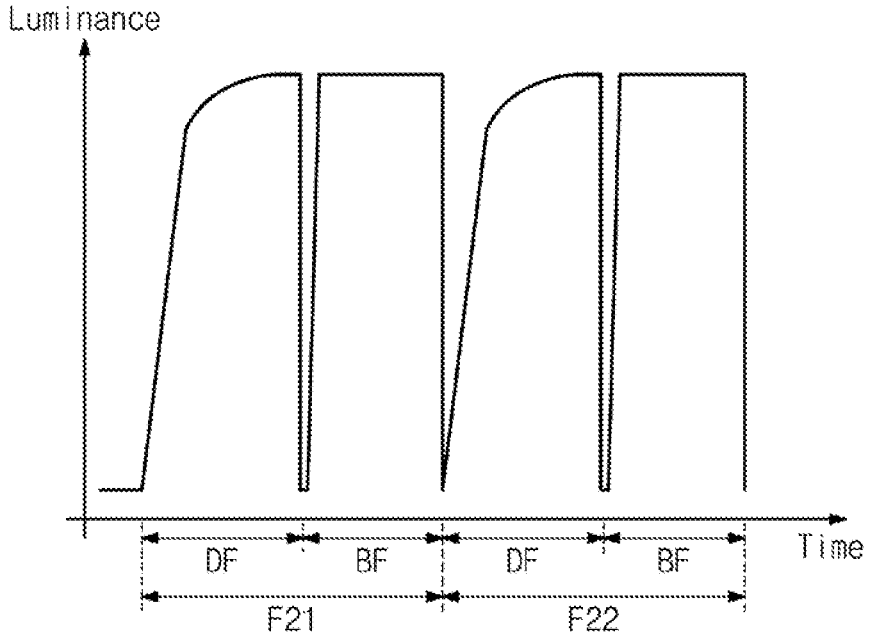
FIG. 13 is a diagram illustrating a change in luminance of a display device in a low frequency mode according to an embodiment of the present disclosure.

FIG. 13 is a diagram illustrating a change in luminance of a display device in a low frequency mode according to an embodiment of the present disclosure.

Referring to FIGS. 5, 7 and 13, the driving frame DF in the low frequency mode includes an initialization period in which a scan signal GIj having the high level is provided, a compensation period in which a scan signal GCj having the high level is provided, and a data writing period in which the scan signal GWj and the scan signal GWj+1 are sequentially activated to the low level. Accordingly, the light emitting diode ED in the pixel PXij emits light only during the data writing period, and the driving current Id flowing through the light emitting diode ED may be determined depending on the gate-source voltage of the first transistor T1. Therefore, the display device DD (refer to FIG. 1) may have a luminance change in a curved shape, during the driving frame DF, as illustrated in FIG. 13.

During the bias frame BF of the low frequency mode, the scan signal GIj and the scan signal GCj are maintained at the low level, and only the scan signal GWj and the scan signal GWj+1 are sequentially activated to the low level. Since there is no initialization period for the first transistor T1, the display device DD (refer to FIG. 1) may maintain the same luminance as the last luminance of the driving frame DF in the bias frame BF.

As illustrated in FIG. 13, when the first driving frequency of the normal mode is 120 Hz and the second driving frequency of the low frequency mode is 60 Hz, each of the frames F21 and F22 may include one driving frame DF and one bias frame BF. In other words, during the low frequency mode, the driving frame DF and the bias frame BF are alternately repeated. When the luminance of the driving frame DF and the luminance of the bias frame BF are different from each other, a test device may recognize the difference as flicker.

As illustrated in FIG. 8, since the first to third pixels PX_R1, PX_G1, and PX_B1 of the first area A1 have a larger pixel area than the fourth to sixth pixels PX_R2, PX_G2, and PX_B2 of the second area A2, the luminance change of the driving frame DF and the bias frame BF in the second area A2 may be greater than the luminance change of the driving frame DF and the bias frame BF in the first area A1. In other words, the change in luminance may be greater in the second area A2 than the first area A1.

Thus, when data signals identical to the data signals for testing the fourth to sixth pixels PX_R2, PX_G2, and PX_B2 of the second area A2 are provided to the first to third pixels PX_R1, PX_G1, and PX_B1 in a test step during the production process of the display panel DP, the test device may erroneously recognize the first to third pixels PX_R1, PX_G1, and PX_B1 as bad pixels.

Figure 14:
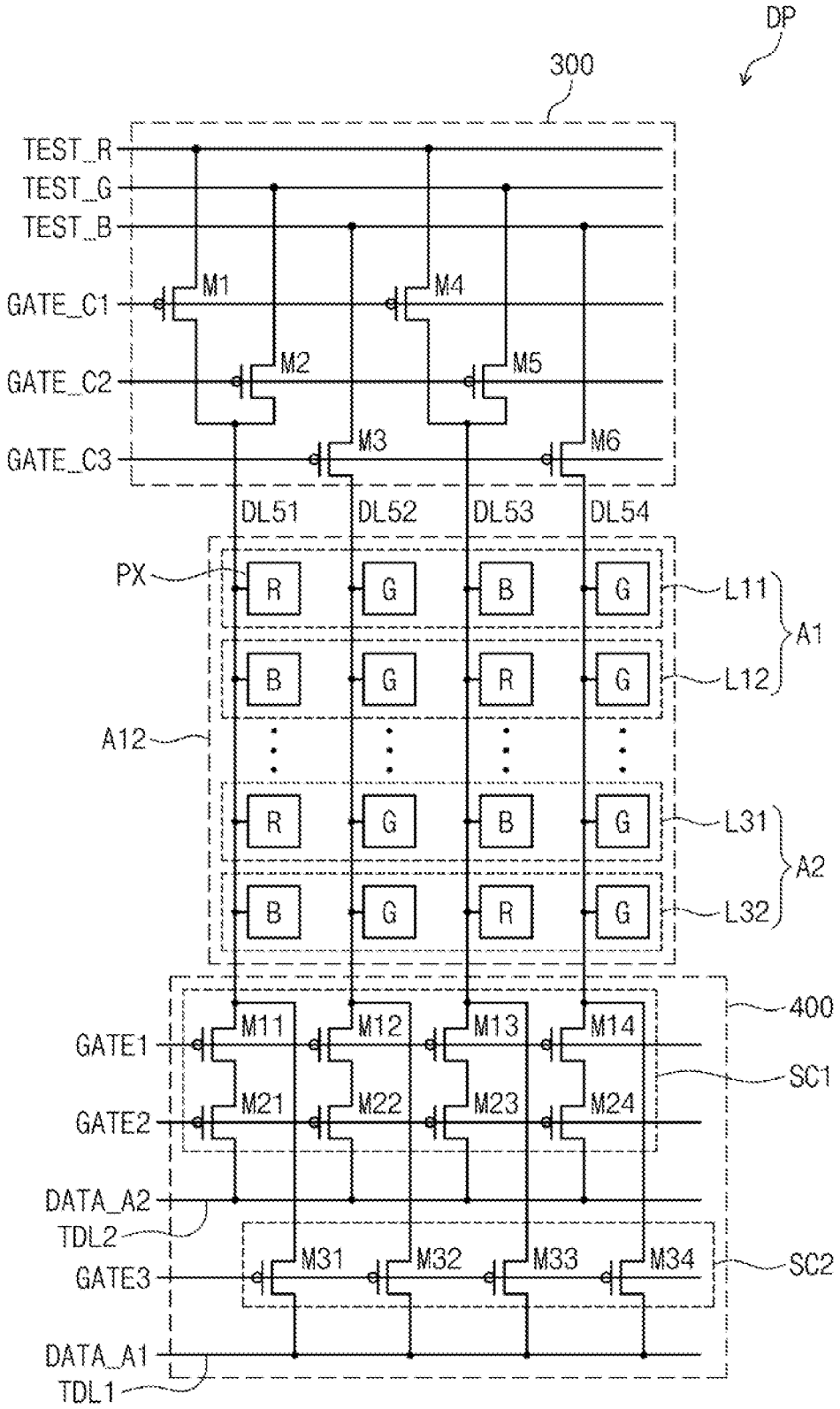
FIG. 14 illustrates a circuit diagram of pixels in an area, a first test circuit, and a second test circuit in a display panel illustrated in FIG. 3.

FIG. 14 illustrates a circuit diagram of the pixels PX in an area A12, the first test circuit 300, and the second test circuit 400 in the display panel DP illustrated in FIG. 3.

Referring to FIG. 14, the area A12 includes a portion of the first area A1 and the second area A2 adjacent to the first area A1 as illustrated in FIG. 3. The pixels PX disposed in the area A12 may include first color pixels R corresponding to a first color, second color pixels G corresponding to a second color, and third color pixels B corresponding to a third color.

In FIG. 14, for convenience of description, it is illustrated and described that the first area A1 includes pixel rows L11 and L12, and the second area A2 includes pixel rows L31 and L32, but the present disclosure is not limited thereto. In other words, the pixel rows included in each of the first area A1 and the second area A2 may be variously changed. For example, more than two pixel rows may be included in at least one of the first area A1 and the second area A2.

In addition, for convenience of description in FIG. 14, it is illustrated and described that the pixels PX are connected to data lines DL51, DL52, DL53 and DL54, but the present disclosure is not limited thereto. In other words, the data lines connected to the pixels PX of the first area A1 and the second area A2 may be variously changed. For example, the pixels PX of the first area A1 may be connected to fewer than four data lines or more than four data lines.

The first test circuit 300 provides test data signals TEST_R, TEST_G TEST_B to the data lines DL51 to DL54 in response to gate control signals GATE_C1, GATE_C2, and GATE_C3 during the driving frame DF (refer to FIG. 7).

The first test circuit 300 includes transistors M1 to M6. Transistors M1 and M4 transfer the test data signal TEST_R to the data lines DL51 and DL53 in response to the gate control signal GATE_C1. The transistors M2 and M5 transfer the test data signal TEST_G to the data lines DL51 and DL53 in response to the gate control signal GATE_C2. The transistors M3 and M6 transfer the test data signal TEST_B to the data lines DL52 and DL54 in response to the gate control signal GATE_C3.

The gate control signals GATE_C1, GATE_C2, GATE_C3 and the test data signals TEST_R, TEST_G, and TEST_B may be received from the test device through the signal pads PD illustrated in FIG. 3.

The second test circuit 400 provides one of a first test data signal DATA_A1 and a second test data signal DATA_A2 to the data lines DL51 to DL54 in response to first to third gate signals GATE1, GATE2, and GATE3 during the bias frame BF (refer to FIG. 7).

Each of the first to third gate signals GATE1, GATE2, and GATE3 provided to the second test circuit 400 during the driving frame DF may be maintained at an inactive level (e.g., the high level). In addition, each of the gate control signals GATE_C1, GATE_C2, and GATE_C3 provided to the first test circuit 300 during the bias frame BF may be maintained at an inactive level (e.g., the high level).

The second test circuit 400 provides the first test data signal DATA_A1 to the data lines connected to the first to third pixels PX_R1, PX_G1, and PX_B1 when the first to third pixels PX_R1, PX_G1, and PX_B1 of the first area A1 are driven, and provides the second test data signal DATA_A2 to the data lines connected to the fourth to sixth pixels PX_R2, PX_G2, and PX_B2 when the fourth to sixth pixels PX_R2, PX_G2, and PX_B2 of the second area A2 are driven.

The second test circuit 400 includes a first switching circuit SC1 and a second switching circuit SC2. The first switching circuit SC1 provides the second test data signal DATA_A2 to the data lines DL51 to DL54 in response to the first gate signal GATE1 and the second gate signal GATE2. The second switching circuit SC2 provides the first test data signal DATA_A1 to the data lines DL51 to DL54 in response to the third gate signal GATE3.

In this embodiment, the first test data signal DATA_A1 is a test data signal to be provided to the pixels PX of the first area A1, and the second test data signal DATA_A2 is a test data signal to be provided to the pixels PX of the second area A2.

The second test circuit 400 includes transistors M11, M12, M13 and M14, M21, M22, M23 and M24, and M31, M32, M33 and M34. The transistors M11 and M21 are sequentially connected in series between the data line DL51 and a second test data line TDL2. The transistors M11 and M21 are included in the first switching circuit SC1. The transistors M12 and M22 are sequentially connected in series between the data line DL52 and the second test data line TDL2. The transistors M12 and M22 are included in the first switching circuit SC1. The transistors M13 and M23 are sequentially connected in series between the data line DL53 and the second test data line TDL2. The transistors M13 and M23 are included in the first switching circuit SC1. The transistors M14 and M24 are sequentially connected in series between the data line DL54 and the second test data line TDL2. The transistors M14 and M24 are included in the first switching circuit SC1. A gate electrode of each of the transistors M11 to M14 receives the first gate signal GATE1, and a gate electrode of each of the transistors M21 to M24 receives the second gate signal GATE2.

The transistors M31 to M34 transfer the first test data signal DATA_A1 to the data lines DL51 to DL54 in response to the third gate signal GATE3. For example, the first transistor M31 transfers the first test data signal DATA_A1 to the data line DL51, the second transistor M32 transfers the first test data signal DATA_A1 to the data line DL52, and so forth.

The transistor M31 is connected between the data line DL51 and a first test data line TDL1. The transistor M32 is connected between the data line DL52 and the first test data line TDL1. The transistor M33 is connected between the data line DL53 and the first test data line TDL1. The transistor M34 is connected between the data line DL54 and the first test data line TDL1. The transistors M31 to M34 are included in the second switching circuit SC2. A gate electrode of each of the transistors M31 to M34 receives the third gate signal GATE3.

In this embodiment, the first test data line TDL1 receives the first test data signal DATA_A1, and the second test data line TDL2 receives the second test data signal DATA_A2. The first test data signal DATA_A1 and the second test data signal DATA_A2 may be the same as or different from each other.

The first, second, and third gate signals GATE1, GATE2, and GATE3, the first test data signal DATA_A1, and the second test data signal DATA_A2 may be provided from the test device through the signal pads PD illustrated in FIG. 3.

When the first and second gate signals GATE1 and GATE2 are activated to the low level and the third gate signal GATE3 is deactivated to the high level, the second test data signal DATA_A2 is provided to the data lines DL51 to DL54.

When the first and second gate signals GATE1 and GATE2 are deactivated to the high level and the third gate signal GATE3 is activated to the low level, the first test data signal DATA_A1 is provided to the data lines DL51 to DL54.

An embodiment of the present disclosure provides the display device DD including: a display panel DP including a plurality of pixels PX respectively connected to a corresponding data line (e.g., one of DL51 to DL54) of a plurality of data lines and a corresponding scan line (e.g., one of scan lines providing gate signal signals GATE1 to GATE 3) of a plurality of scan lines; and a test circuit 300/400 electrically connected to the data lines, and wherein the display panel DP includes a first area A1 having a first light transmittance and a second area A2 having a second light transmittance, wherein the plurality of pixels includes a first pixel (e.g., PX_R1) disposed in the first area A1 and a second pixel (e.g., PX_R2) disposed in the second area A2, wherein the test circuit 400 provides a first test data signal DATA_A1 to a data line connected to the first pixel among the plurality of data lines when the first pixel is driven, and provides a second test data signal DATA_A2 to a data line connected to the second pixel among the plurality of data lines when the second pixel is driven, and wherein a voltage level of the first test data signal is different from a voltage level of the second test data signal.

Figure 15:
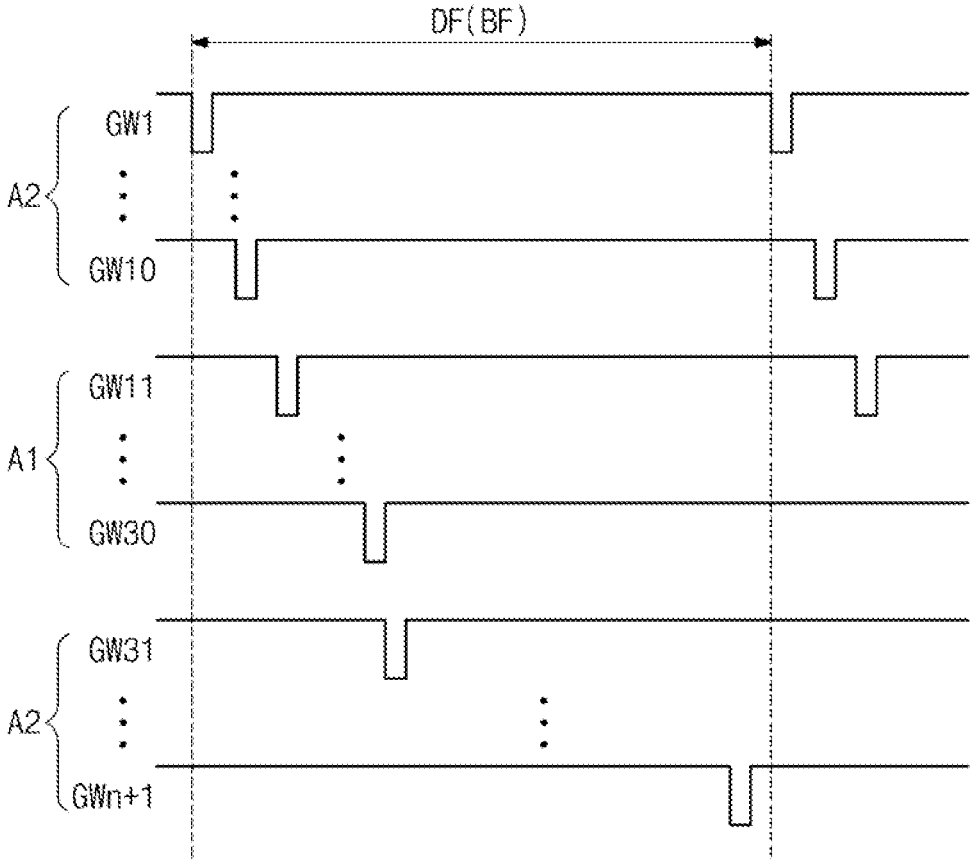
FIG. 15 illustrates scan signals provided to pixels during a driving frame or a bias frame according to an embodiment of the present disclosure.

FIG. 15 illustrates scan signals provided to pixels during a driving frame or a bias frame according to an embodiment of the present disclosure.

Referring to FIGS. 14 and 15, among the scan signals GW1 to GWn+1, the scan signals GW11 to GW30 correspond to the first area A1, and the scan signals GW1 to GW10, and GW31 to GWn+1 correspond to the second area A2.

In an embodiment of the present disclosure, the scan signals GW11 and GW12 may be provided to the gate electrode of the second transistor T2 (refer to FIG. 5) of pixels in the pixel rows L11 and L12 of the first area A1. The scan signals GW31 and GW32 may be provided to the gate electrode of the second transistor T2 (refer to FIG. 5) of pixels in the pixel rows L31 and L32 of the second area A2.

Figure 16:
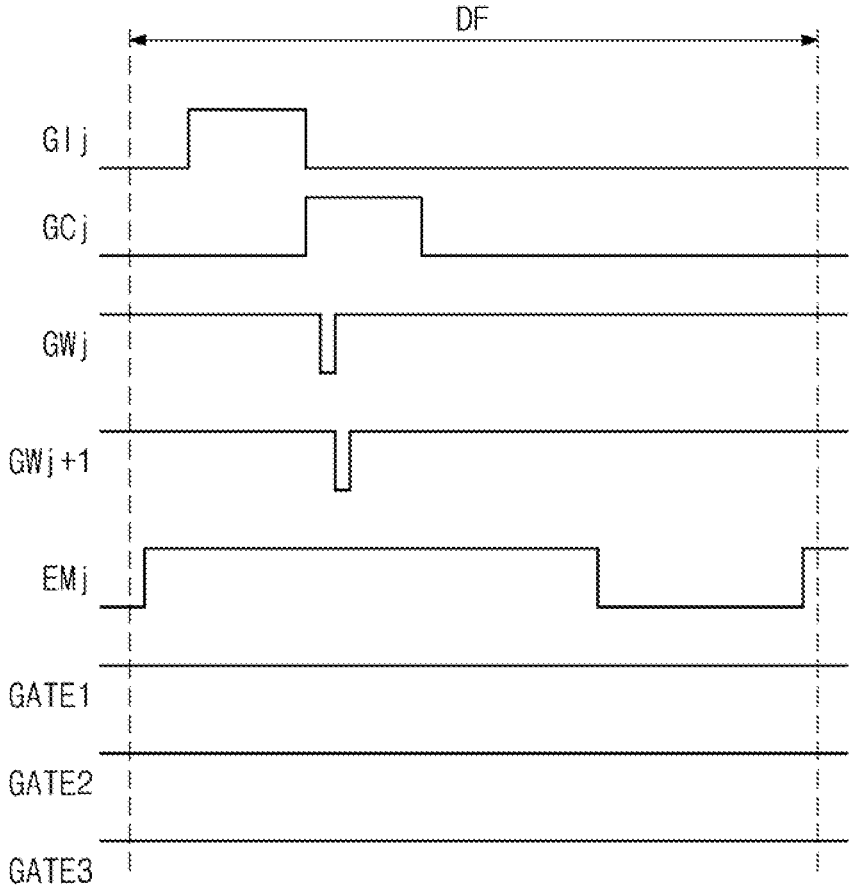
FIG. 16 illustrates scan signals provided to pixels in a j-th row and first, second, and third gate signals provided to a second test circuit during a driving frame according to an embodiment of the present disclosure.

FIG. 16 illustrates the scan signals GIj, GCj, GWj, and GWj+1 provided to the pixels PXij in the j-th row and the first, second, and third gate signals GATE1, GATE2, and GATE3 provided to the second test circuit 400 during the driving frame as an example. An operation of the display device according to an embodiment of the present disclosure will be described with reference to FIGS. 5 and 16.

Referring to FIGS. 5, 14, and 16, a scan signal GIj having the high level is provided through the scan line GILj during the initialization period within the driving frame DF. In this case, 'j' is a natural number from 1 to n. The fourth transistor T4 is turned on in response to the scan signal GIj having the high level, and the first initialization voltage VINT is transferred to the gate electrode of the first transistor T1 through the fourth transistor T4 to initialize the first transistor T1.

Subsequently, when the scan signal GCj having the high level is supplied through the scan line GCLj during a data programming and the compensation period, the third transistor T3 is turned on. The first transistor T1 is diode-connected by the turned-on third transistor T3 and is forward biased. In addition, the second transistor T2 is turned on by the scan signal GIj having the low level. As a result, a compensation voltage, which is reduced by a threshold voltage of the first transistor T1 from a voltage of the data signal Di supplied from the data line DLi, is applied to the gate electrode of the first transistor T1. In other words, the gate voltage applied to the gate electrode of the first transistor T1 may be the compensation voltage.

The first driving voltage ELVDD and the compensation voltage may be applied to both ends of the capacitor Cst, and a charge corresponding to a voltage difference between both ends may be stored in the capacitor Cst.

In addition, the seventh transistor T7 is turned on by receiving the scan signal GWkj+1 having the low level through the scan line GWLj+1. A portion of the driving current Id by the seventh transistor T7 may pass through the seventh transistor T7 as a bypass current.

Subsequently, during an emission period, the emission signal EMj supplied from the emission control line EMLj is changed from the high level to the low level. During the emission period, the fifth transistor T5 and the sixth transistor T6 are turned on by the emission signal EMj having the low level. As a result, the driving current Id is generated depending on a voltage difference between a gate voltage of the gate electrode of the first transistor T1 and the first driving voltage ELVDD, and the driving current Id is supplied to the light emitting diode ED through the sixth transistor T6. Accordingly, a current flows through the light emitting diode ED.

During the driving frame DF of a test mode, the first gate signal GATE1, the second gate signal GATE2, and the third gate signal GATE3 are maintained at the high level, which is an inactive level.

During the driving frame DF of the test mode, the first test circuit 300 illustrated in FIG. 14 may provide the test data signals TEST_R, TEST_G, and TEST_B to the data lines DL52 to DL54.

Figure 17:
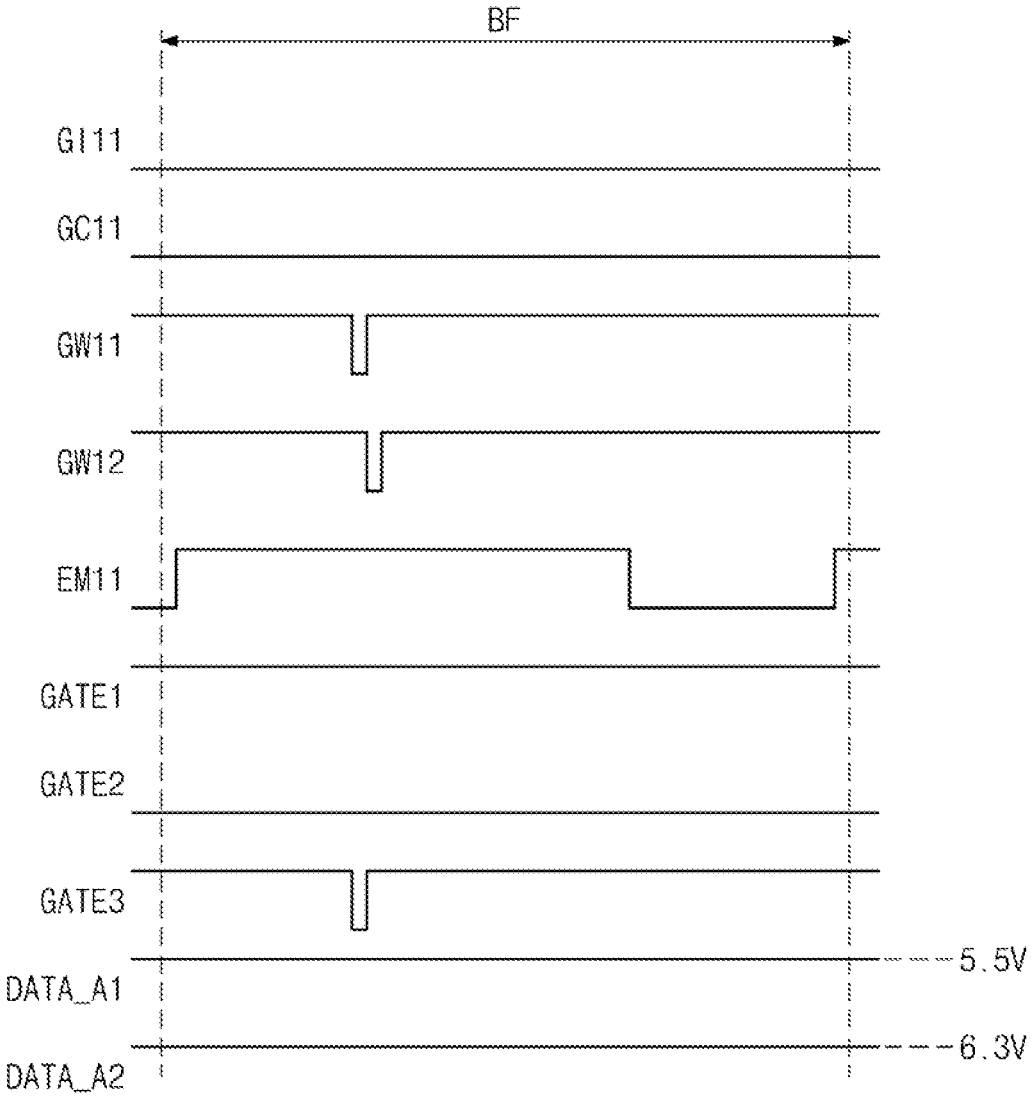
FIG. 17 illustrates scan signals provided to pixels in a pixel row of a first area and first, second, and third gate signals provided to a second test circuit during a bias frame according to an embodiment of the present disclosure.

FIG. 17 illustrates scan signals GI11, GC11, GW11, and GW12 provided to the pixels PX in the pixel row L11 of the first area A1 during the bias frame BF and the first, second, and third gate signals GATE1, GATE2, and GATE3 provided to the second test circuit 400 during the bias frame BF.

Referring to FIGS. 5, 14, and 17, the scan signals GI11, GC11, GW11, and GW12 provided to the pixels PX of the pixel row L11 of the first area A1 and operations of the pixels are similar to the scan signals GIj, GCj, GWj, and GWj+1 provided to the pixels PXij in the j-th row and the operations of the pixels PXij as illustrated in FIG. 16, and thus additional description will be omitted to avoid redundancy.

During the test mode (in both the driving frame DF and the bias frame BF), the second gate signal GATE2 is maintained at the low level, which is an active level.

While the pixel row L11 of the first area A1 of the bias frame BF in the test mode is driven, the first gate signal GATE1 is maintained at the high level, which is an inactive level. When the pixel row L11 of the first area A1 of the bias frame BF in the test mode is driven, the third gate signal GATE3 is activated to the low level at the same time as the scan signal GW11. Therefore, the first test data signal DATA_A1 may be provided to the data lines D51 to D54 connected to the pixel row L11 of the first area A1 during the bias frame BF of the test mode. For example, during the bias frame BF of the test mode, the first test data signal DATA_A1 may be provided to the first to third pixels PX_R1, PX_G1, and PX_B1 (refer to FIG. 8) of the first area A1. FIG. 17 illustrates that the first test data signal DATA_A1 may be about 5.5V, but the present disclosure is not limited thereto.

Figure 18:
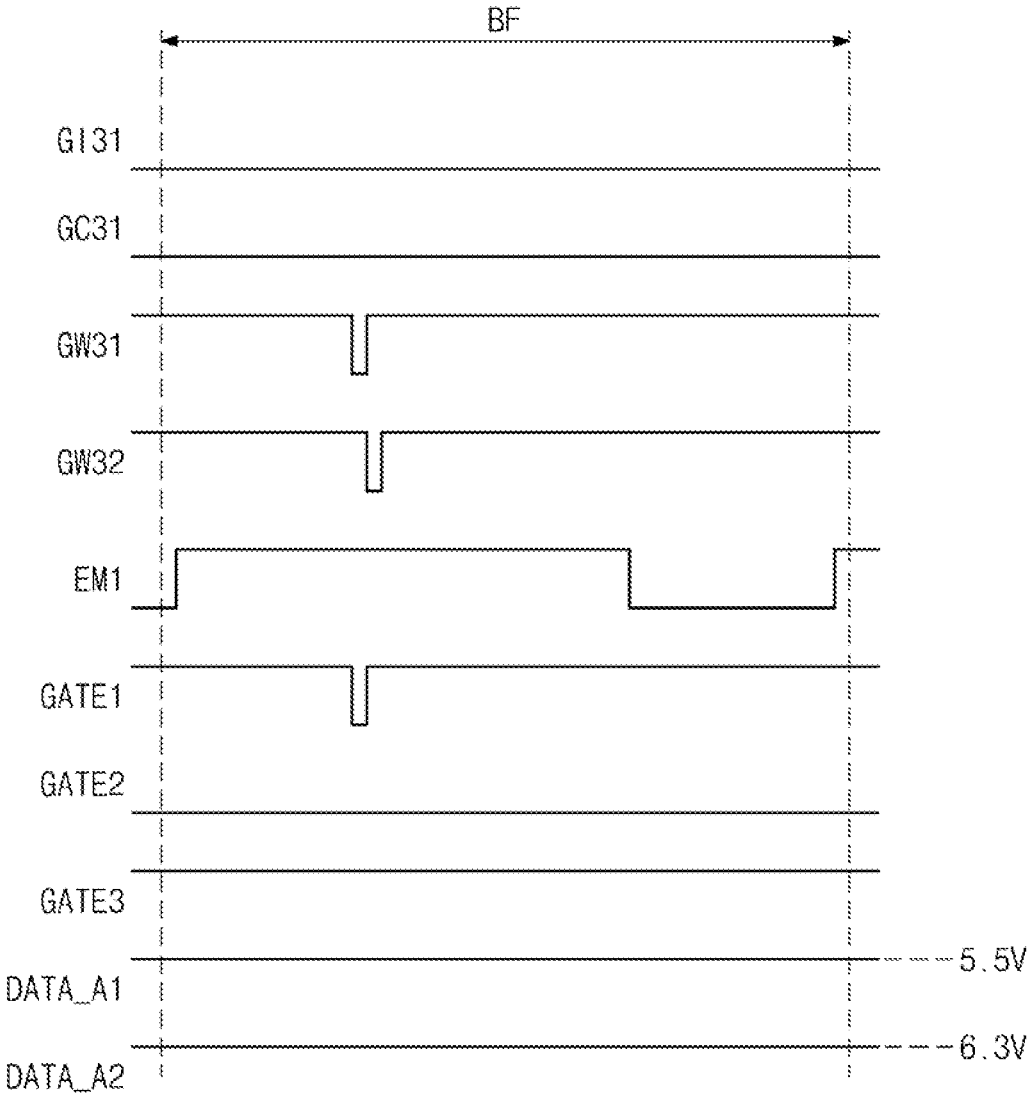
FIG. 18 illustrates scan signals provided to pixels in a pixel row of a second area and first, second, and third gate signals provided to a second test circuit during a bias frame according to an embodiment of the present disclosure.

FIG. 18 illustrates scan signals G131, GC31, GW31, and GW32 provided to the pixels of a pixel row L31 of the second area A2 during the bias frame BF and the first, second, and third gate signals GATE1, GATE2, and GATE3 provided to the second test circuit 400 during the bias frame BF.

Referring to FIGS. 5, 14 and 18, the scan signals GI31, GC31, GW31, and GW32 provided to the pixels PX of the pixel row L31 in the second area A2 and operations of the pixels PX are similar to the scan signals GIj, GCj, GWj, and GWj+1 provided to the pixels PXij in the j-th row and the operations of the pixels PXij as illustrated in FIG. 16, and thus additional description will be omitted to avoid redundancy.

During the test mode (in both the driving frame DF and the bias frame BF), the second gate signal GATE2 is maintained at the low level, which is an active level.

While the pixel row L31 of the second area A2 of the bias frame BF in the test mode is driven, the third gate signal GATE3 is maintained at the high level, which is an inactive level. When the pixel row L31 of the second area A2 of the bias frame BF in the test mode is driven, the first gate signal GATE1 is activated to the low level at the same time as the scan signal GW31. Therefore, the second test data signal DATA_A2 may be provided to the data lines D51 to D54 connected to the pixel row L31 of the second area A2 during the bias frame BF in the test mode. In other words, the second test data signal DATA_A2 may be provided to the fourth to sixth pixels PX_R2, PX_G2, and PX_B2 (refer to FIG. 8) of the second area A2 during the bias frame BF in the test mode. FIG. 18 illustrates that the second test data signal DATA_A2 may be about 6.3V, but the present disclosure is not limited thereto.

The first test data signal DATA_A1 may have a first voltage level, and the second test data signal DATA_A2 may have a second voltage level. In one embodiment of the present disclosure, the first voltage level may be lower than the second voltage level. For example, the first voltage level of the first test data signal DATA_A1 is 5.5 V, and the second voltage level of the second test data signal DATA_A2 is 6.3 V.

As described above, a voltage level of the first test data signal DATA_A1 provided to the first to third pixels PX_R1, PX_G1, and PX_B1 (refer to FIG. 8) of the first area A1 may be set differently from a voltage level of the second test data signal DATA_A2 provided to the fourth to sixth pixels PX_R2, PX_G2, and PX_B2 (refer to FIG. 8) of the second area A2. Accordingly, it is possible to minimize an error in which the pixels of the first area A1 are determined to be defective in the test mode even though the first to third pixels PX_R1, PX_G1, and PX_B1 (refer to FIG. 8) of the first area A1 are in a normal state.

Figure 19:
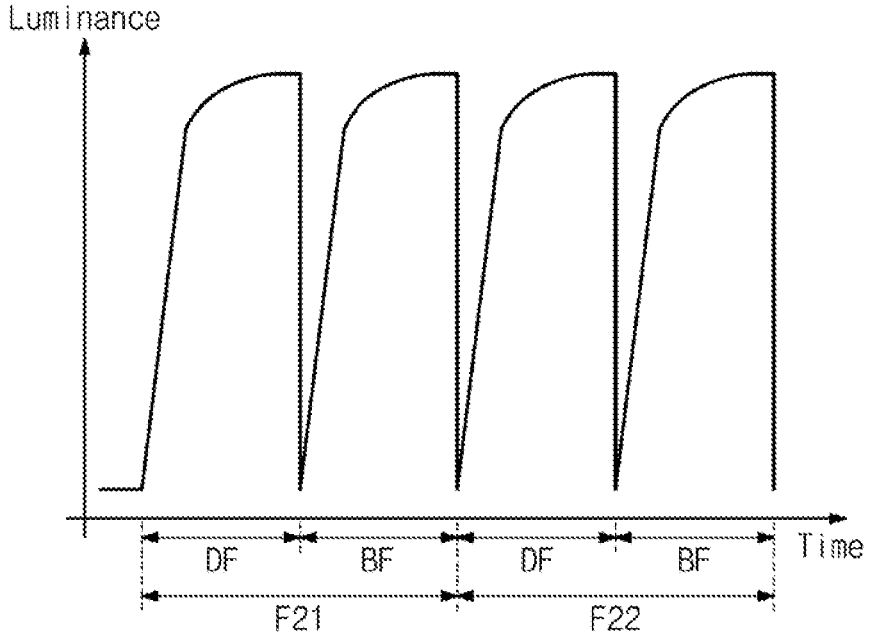
FIG. 19 is a diagram illustrating a change in luminance of a display device in a low frequency mode according to an embodiment of the present disclosure.

FIG. 19 is a diagram illustrating a change in luminance of a display device in a low frequency mode according to an embodiment of the present disclosure.

First, referring to FIGS. 16 and 19, the driving frame DF of the test mode includes the initialization period in which the scan signal GIj having the high level is provided, the compensation period in which the scan signal GCj having the high level is provided, and the data writing period in which the scan signal GWj and the scan signal GWj+1 are sequentially activated to the low level. Therefore, the display device DD (refer to FIG. 1) may have a curved luminance change during the driving frame DF.

Referring to FIGS. 14, 17 and 19, the first test data signal DATA_A1 of the first voltage level (e.g., 5.5 V) is provided to the data lines DL51 to DL54 of the first area A1 during the bias frame BF in the test mode. Since a high voltage is provided to the first electrode (e.g., the source S1 illustrated in FIG. 10) of the first transistor T1, the gate-source voltage of the first transistor T1 becomes a negative voltage, such that the first transistor T1 may be expected to be initialized.

In addition, referring to FIGS. 14, 18, and 19, the second test data signal DATA_A2 of the second voltage level (e.g., 6.3 V) is provided to the data lines DL51 to DL54 of the second area A2 during the bias frame BF in the test mode. Since a high voltage is provided to the first electrode (e.g., the source S1 illustrated in FIG. 10) of the first transistor T1, the gate-source voltage of the first transistor T1 becomes a negative voltage, such that the first transistor T1 may be expected to be initialized.

As a result, the display device DD (refer to FIG. 1) may have a luminance change in a curved shape similar to that of the driving frame DF in the bias frame BF of the test mode.

As illustrated in FIG. 7, a pixel area of the first to third pixels PX_R1, PX_G1, and PX_B1 of the first area A1 is greater than that of the fourth to sixth pixels PX_R2, PX_G2, and PX_B2 of the second area A2. When the second test data signal DATA_A2 provided to the fourth to sixth pixels PX_R2, PX_G2, and PX_B2 in the second area A2 is applied to the first to third pixels PX_R1, PX_G1, and PX_B1 in the first area A1, a greater difference in luminance between the driving frame DF and the bias frame BF may be detected in the first area A1 than in the second area A2.

Therefore, the luminance difference between the driving frame DF and the bias frame BF of the first area A1 may be reduced by lowering the first voltage level of the first test data signal DATA_A1 provided to the data lines DL51 to DL54 of the first area A1 than the second voltage level of the second test data signal DATA_A2 provided to the data lines DL51 to DL54 of the second area A2.

Figure 20:
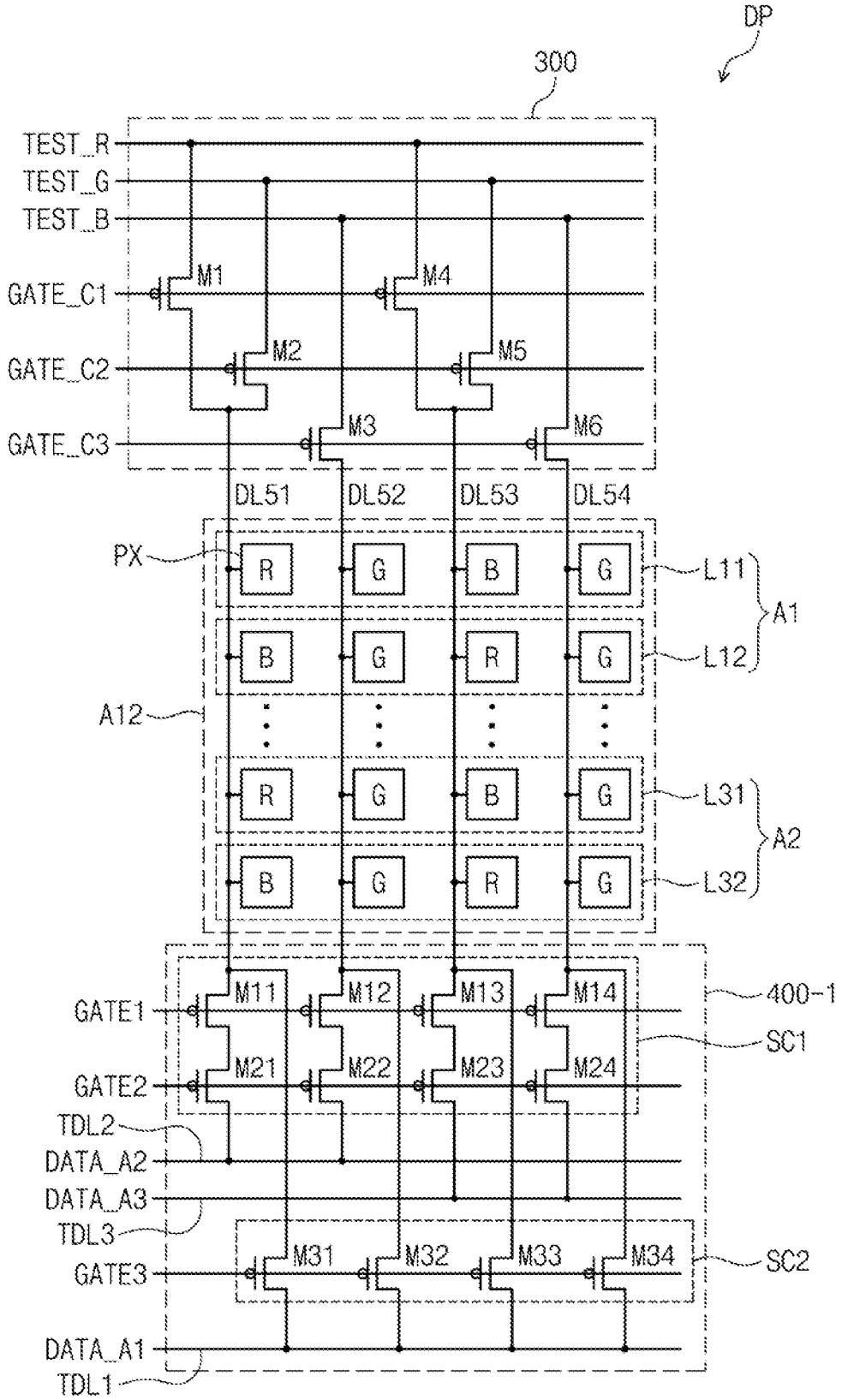
FIG. 20 illustrates a circuit diagram of pixels in an area, a first test circuit, and a second test circuit in a display panel illustrated in FIG. 3.

FIG. 20 illustrates a circuit diagram of the pixels in the area A12, the first test circuit 300, and a second test circuit 400-1 in the display panel DP illustrated in FIG. 3.

Since the area A12 and the first test circuit 300 illustrated in FIG. 20 are the same as the area A12 and the first test circuit 300 illustrated in FIG. 14, the same reference numerals are used and additional descriptions are omitted to avoid redundancy.

The second test circuit 400-1 provides one of the first test data signal DATA_A1, the second test data signal DATA_A2, and the third test data signal DATA_A3 to the data lines DL51 to DL54 in response to the first to third gate signals GATE1, GATE2, and GATE3 during the test mode.

The second test circuit 400-1 includes the first switching circuit SC1 and the second switching circuit SC2. The first switching circuit SC1 provides the second test data signal DATA_A2 to the data lines DL51 and DL52 and provides the third test data signal DATA_A3 to the data lines DL53 and DL54, in response to the first gate signal GATE1 and the second gate signal GATE2. The second switching circuit SC2 provides the first test data signal DATA_A1 to the data lines DL51 to DL54 in response to the third gate signal GATE3.

In this embodiment, the first test data signal DATA_A1 is a test data signal to be provided to the pixels PX of the first area A1, the second test data signal DATA_A2 is a test data signal to be provided to the pixels PX connected to the data lines DL51 and DL52 of the second area A2, and the third test data signal DATA_A3 is a test data signal to be provided to the pixels PX connected to the data lines DL53 and DL54 of the second area A2.

The second test circuit 400-1 includes the transistors M11 to M14, M21 to M24, and M31 to M34. The transistors M11 and M21 are sequentially connected in series between the data line DL51 and the second test data line TDL2. The transistors M12 and M22 are sequentially connected in series between the data line DL52 and the second test data line TDL2. The transistors M13 and M23 are sequentially connected in series between the data line DL53 and a third test data line TDL3. The transistors M14 and M24 are sequentially connected in series between the data line DL54 and the third test data line TDL3. The gate electrode of each of the transistors M11 to M14 receives the first gate signal GATE1, and the gate electrode of each of the transistors M21 to M24 receives the second gate signal GATE2.

The first switching circuit SC1 of the second test circuit 400-1 may be used to check whether an unwanted electrical connection (e.g., a short) of the data lines DL51 and DL52 and the data lines DL53 and DL54 occurs in the test mode.

The transistors M31 to M34 transfer the first test data signal DATA_A1 to the data lines DL51 to DL54 in response to the third gate signal GATE3.

The second test circuit 400 illustrated in FIG. 14 and the second test circuit 400-1 illustrated in FIG. 20 illustrate an embodiment of the present disclosure, and the second test circuit 400 and the second test circuit 400-1 may be variously changed and implemented.

According to an embodiment of the present disclosure, the display device may test performance of a display panel in a manufacturing stage. In particular, test reliability may be increased when a driving frequency of the display panel operates at a frequency lower than a normal frequency by performing tests under conditions suitable for characteristics of the pixels disposed in a first area overlapping an electronic module and characteristics of the pixels disposed in a second area not overlapping the electronic module.

While the present disclosure has been described with reference to embodiments thereof, it will be apparent to those of ordinary skill in the art that various changes and modifications may be made thereto without departing from the spirit and scope of the present disclosure as set forth in the following claims.

What is claimed is:

1. A display device, comprising:

a display panel including a plurality of pixels respectively connected to a corresponding data line of a plurality of data lines and a corresponding scan line of a plurality of scan lines; and a test circuit electrically connected to the data lines, and wherein the display panel includes a first area having a first light transmittance and a second area having a second light transmittance, wherein the plurality of pixels includes a first pixel disposed in the first area and a second pixel disposed in the second area, wherein the test circuit provides a first test data signal to a data line connected to the first pixel among the plurality of data lines in a bias frame, and provides a second test data signal to a data line connected to the second pixel among the plurality of data lines in the bias frame, wherein a voltage level of the first test data signal is different from a voltage level of the second test data signal during the bias frame such that a luminance change of the display device has a curved shape in the bias frame similar to that of a driving frame, and wherein the driving frame and the bias frame are alternately repeated in a single frame.

2. The display device of claim 1, wherein the first light transmittance of the first area is greater than the second light transmittance of the second area.

3. The display device of claim 1, wherein a first voltage level of the first test data signal is greater than a second voltage level of the second test data signal.

4. The display device of claim 1, wherein the display panel operates in a normal mode at a first driving frequency and a low frequency mode at a second driving frequency lower than the first driving frequency, wherein each of the plurality of pixels includes a plurality of transistors, and wherein the low frequency mode includes the driving frame in which all of the plurality of transistors are driven and the bias frame in which less than all of the plurality of transistors are driven.

5. The display device of claim 4, wherein the test circuit provides the first test data signal to the data line connected to the first pixel when the first pixel is driven during the bias frame, and provides the second test data signal to the data line connected to the second pixel when the second pixel is driven during the bias frame.

6. The display device of claim 4, wherein the test circuit is in an inactive state during the driving frame.

7. The display device of claim 4, wherein each of the first pixel and the second pixel includes:

a first transistor including a first electrode electrically connected to a first voltage line, a second electrode, and a gate electrode;

a second transistor including a first electrode connected to the corresponding data line of the plurality of data lines, a second electrode electrically connected to the first electrode of the first transistor, and a gate electrode for receiving a first scan signal;

a third transistor including a first electrode electrically connected to the second electrode of the first transistor, a second electrode electrically connected to the gate electrode of the first transistor, and a gate electrode for receiving a second scan signal; and a light emitting diode including a first electrode electrically connected to the second electrode of the first transistor and a second electrode connected to a second voltage line for receiving a second voltage, and wherein the first scan signal and the second scan signal are activated during the driving frame, and wherein the first scan signal is activated and the second scan signal maintains an inactive state during the bias frame.

8. The display device of claim 7, wherein each of the first transistor and the second transistor is a P-type transistor, and wherein the third transistor is an N-type transistor.

9. The display device of claim 1, wherein the test circuit includes:

a first switching circuit configured to provide the second test data signal to the plurality of data lines in response to a first gate signal and a second gate signal; and a second switching circuit configured to provide the first test data signal to the plurality of data lines in response to a third gate signal.

10. The display device of claim 9, wherein the first switching circuit includes:

a first switching transistor and a second switching transistor connected in series between a data line electrically connected to both the first pixel and the second pixel and a second test data line transferring the second test data signal, wherein a gate electrode of the first switching transistor receives the first gate signal, and wherein a gate electrode of the second switching transistor receives the second gate signal.

11. The display device of claim 9, wherein the second switching circuit includes:

a third switching transistor connected in series between a data line electrically connected to both the first pixel and the second pixel and a first test data line transferring the first test data signal, and wherein a gate electrode of the third switching transistor receives the third gate signal.

12. The display device of claim 1, further comprising:

an electronic module overlapping the first area.

13. The display device of claim 12, wherein the electronic module is a camera.

14. The display device of claim 1, wherein the number of first pixels per unit area of the first area is less than the number of second pixels per unit area of the second area.

15. A display device, comprising:

a display panel including a plurality of pixels respectively connected to a corresponding data line of a plurality of data lines and a corresponding scan line of a plurality of scan lines; and a test circuit disposed on the display panel and electrically connected to the data lines, and wherein the display panel includes a first area having a first light transmittance and a second area having a second light transmittance, wherein the plurality of pixels includes a first pixel disposed in the first area and a second pixel disposed in the second area, and wherein each of the first pixel and the second pixel includes:

a first transistor including a first electrode electrically connected to a first voltage line, a second electrode, and a gate electrode;

a second transistor including a first electrode connected to the corresponding data line of the plurality of data lines, a second electrode electrically connected to the first electrode of the first transistor, and a gate electrode for receiving a first scan signal;

a third transistor including a first electrode electrically connected to the second electrode of the first transistor, a second electrode electrically connected to the gate electrode of the first transistor, and a gate electrode for receiving a second scan signal; and a light emitting diode including a first electrode electrically connected to the second electrode of the first transistor and a second electrode connected to a second voltage line for receiving a second voltage, and wherein the first scan signal and the second scan signal are activated during a driving frame, and the first scan signal is activated and the second scan signal maintains an inactive state during a bias frame, wherein the test circuit provides a first test data signal to the first pixel when the first scan signal provided to the first pixel during the bias frame is activated, and provides a second test data signal to the second pixel when the first scan signal provided to the second pixel during the bias frame is activated, wherein a voltage level of the first test data signal is different from a voltage level of the second test data signal during the bias frame such that a luminance change of the display device has a curved shape in the bias frame similar to that of a driving frame, and wherein the driving frame and the bias frame are alternately repeated in a single frame.

16. The display device of claim 15, wherein the first light transmittance of the first area is greater than the second light transmittance of the second area, and wherein a first voltage level of the first test data signal is greater than a second voltage level of the second test data signal.

17. The display device of claim 15, wherein the display panel operates in a normal mode at a first driving frequency and a low frequency mode at a second driving frequency lower than the first driving frequency, and wherein the low frequency mode includes the driving frame and the bias frame.

18. The display device of claim 15, wherein the test circuit is in an inactive state during the driving frame.

19. The display device of claim 15, wherein the test circuit includes:

a first switching circuit configured to provide the second test data signal to the plurality of data lines in response to a first gate signal and a second gate signal; and a second switching circuit configured to provide the first test data signal to the plurality of data lines in response to a third gate signal.

20. The display device of claim 15, further comprising:

an electronic module overlapping the first area.

* * * * *